US007134242B2

(12) United States Patent
Fitzgerald

(10) Patent No.: US 7,134,242 B2
(45) Date of Patent: Nov. 14, 2006

(54) AUTOMATED SLIDING USER DOORS AND DOOR MECHANISMS FOR A DISPENSER

(75) Inventor: Robert M. Fitzgerald, Norcross, GA (US)

(73) Assignee: Innovative Product Achievements, Inc., Duluth, GA (US)

( * ) Notice: Subject to any disclaimer, the term of this patent is extended or adjusted under 35 U.S.C. 154(b) by 273 days.

(21) Appl. No.: 10/671,301

(22) Filed: Sep. 24, 2003

(65) Prior Publication Data

US 2005/0060938 A1 Mar. 24, 2005

(51) Int. Cl.
*E05D 15/26* (2006.01)
*A47F 1/00* (2006.01)
*A47B 88/00* (2006.01)

(52) U.S. Cl. ..... 49/125; 312/97; 312/97.1; 312/322

(58) Field of Classification Search ..... 49/125, 49/38; 221/247, 249; 160/84.02, 265, 188, 160/189, 321, 345; 312/35, 97, 97.1, 319.5–319.8, 312/134, 306, 312, 311, 322; 198/704, 706, 198/711, 712; 211/121, 1.51, 1.56, 1.54, 211/1.55

See application file for complete search history.

(56) References Cited

U.S. PATENT DOCUMENTS

| | | | | |
|---|---|---|---|---|
| 314,219 | A | | 3/1885 | Brownell |
| 762,692 | A | | 6/1904 | Davis |
| 970,380 | A | | 9/1910 | Monson |
| 1,324,587 | A | | 12/1919 | Elliott |
| 1,462,646 | A | | 7/1923 | Lancaster |
| 1,552,436 | A | | 9/1925 | Lancaster |
| 1,628,865 | A | * | 5/1927 | Webster ..... 312/8.16 |
| 1,774,808 | A | | 9/1930 | Morton |
| 2,007,552 | A | | 7/1935 | Vetterlein |
| 2,254,150 | A | | 8/1941 | Kingsland |
| 2,260,013 | A | | 10/1941 | Elvers |
| 2,648,587 | A | * | 8/1953 | Lane ..... 312/306 |
| 2,649,301 | A | | 8/1953 | Signore |
| 2,908,051 | A | | 10/1959 | Sparkes |
| 2,979,328 | A | | 4/1961 | Henrikson |
| 3,394,497 | A | | 7/1968 | Case |
| 3,703,325 | A | * | 11/1972 | Schnarr ..... 312/307 |
| 4,925,258 | A | * | 5/1990 | Ludwig et al. ..... 312/323 |
| 5,237,777 | A | | 8/1993 | Houston et al. |
| 5,249,392 | A | | 10/1993 | Houston et al. |
| 5,836,662 | A | | 11/1998 | Robey |
| 5,924,780 | A | * | 7/1999 | Ammon et al. ..... 312/223.2 |
| 5,974,737 | A | | 11/1999 | Barros et al. |
| 6,502,718 | B1 | | 1/2003 | Fitzgerald et al. |

* cited by examiner

*Primary Examiner*—Hugh B. Thompson, II
(74) *Attorney, Agent, or Firm*—Alston & Bird LLP

(57) ABSTRACT

A dispenser that includes one or more sliding user doors for selectively restricting access to items disposed within the dispenser. In one embodiment, the dispenser includes a unique locking and drive mechanism that allows a single actuator to both: (1) lock and unlock a sliding user door; and (2) move the user door into and out of driving engagement with a drive mechanism that may be used to open and close the user door. In a particular embodiment, the dispenser further includes a door support that supports the weight of a downward-opening sliding user door when the downward-opening user door is in a closed position, but that may be selectively repositioned to facilitate the movement of the user door from a closed to an open position.

42 Claims, 19 Drawing Sheets

AUTOMATED SLIDING USER DOORS AND DOOR MECHANISMS FOR A DISPENSER

BACKGROUND OF THE INVENTION

Automated dispensers are currently used to dispense items ranging from food items, to beverages, to clothing items. However, there is a need for improved dispensers that, for example, consume less space, cost less to manufacture, include fewer parts, and/or operate more efficiently than current dispensers.

SUMMARY OF THE INVENTION

In one embodiment of the invention, a drive mechanism for moving a sliding door relative to an enclosure comprises a drive assembly that includes: (1) a first drive subassembly that is adjacent a first lateral side of the sliding door; and (2) a second drive subassembly that is adjacent a second lateral side of the sliding door. The drive mechanism further includes a door linking assembly that is configured to be moved between: (1) a first position, in which the door linking assembly is positioned to link the sliding door to the drive assembly and thereby allow the drive assembly to slide the sliding door relative to the enclosure; and (2) a second position, in which the door linking assembly is not positioned to link the sliding door to the drive assembly. In one embodiment of the invention, the first and second doors are positioned in a substantially vertical array.

In a particular embodiment of the invention, the door linking assembly comprises a rotatable member that is adapted so that when the door linking assembly is in the first position, the rotatable member is in a first angular orientation in which the rotatable member engages the drive assembly so that the drive assembly is in driving engagement with the sliding door. In this embodiment, when the door linking assembly is in the second position, the rotatable member is in a second angular orientation in which the rotatable member does not engage the drive assembly in a manner that causes the drive assembly to be in driving engagement with the sliding door. In one embodiment of the invention, the rotatable member (which may, for example, be substantially U-shaped or V-shaped) is adapted so that when the door linking assembly is in the second position, the rotatable member engages a restricting member adjacent the sliding door. This may serve to prevent users from opening the sliding door.

A dispenser according to another embodiment of the invention comprises a plurality of compartments, each of the compartments defining an interior portion and an opening through which a user may access items stored within the interior portion. In this embodiment, the dispenser further comprises a first sliding door that is positioned to selectively restrict access to a first one of the compartments by sliding between a first-door closed position, in which the first sliding door prevents users from accessing an interior portion of the first compartment, and a first-door open position, in which the first sliding door allows users to access the interior portion of the first compartment. In one embodiment, when the first sliding door is in the first-door closed position, the first sliding door is positioned in front of an access opening of the first compartment. Similarly, in a particular embodiment, when the first sliding door is in the first-door open position, the first sliding door is positioned substantially below the access opening of the first compartment.

In this embodiment of the invention, the dispenser further comprises a second sliding door that is positioned to selectively restrict access to a second one of the compartments by sliding between a second-door closed position, in which the second sliding door prevents users from accessing an interior portion of the second compartment, and a second-door open position, in which the second sliding door allows users to access the interior portion of the second compartment. In one embodiment, when the second sliding door is in the second-door closed position, the second sliding door is positioned in front of an access opening of the second compartment. In a particular embodiment, when the second sliding door is in the second-door open position, the second sliding door is positioned substantially above the access opening of the second compartment.

In one embodiment of the invention, the dispenser includes a third sliding door that is positioned to selectively restrict access to a third one of the compartments by sliding between a third-door closed position, in which the third sliding door prevents users from accessing an interior portion of the third compartment, and a third-door open position, in which the third sliding door allows users to access the interior portion of the third compartment. In this embodiment, when the third sliding door is in the door-compartment closed position, the third sliding door is positioned in front of an access opening of the third compartment. In a particular embodiment, when the third sliding door is in the third-door open position, the third sliding door is positioned substantially above the access opening of the third compartment.

In one embodiment of the invention, the dispenser includes a single drive assembly that is adapted to: (1) move the first door between the first-door open position and first-door closed position; (2) move the second door between the second-door open position and second-door closed position; and (3) move the third door between the third-door open position and third-door closed position.

A dispenser according to a further embodiment of the invention comprises a plurality of compartments, each of the compartments defining an interior portion and an opening through which a user may access items stored within the interior portion. In this embodiment, the dispenser further comprises a first sliding door that is associated with a first one of the compartments and that is positioned to selectively restrict access to the first one of the compartments by sliding, in a substantially vertical direction, between: (1) a first-door closed position in which the first sliding door prevents users from accessing an interior portion of the first compartment; and (2) a first-door open position in which the first sliding door allows users to access the interior portion of the first compartment.

In this embodiment of the invention, the dispenser further comprises a second sliding door that is associated with a second one of the compartments and that is positioned to selectively restrict access to the second one of the compartments by sliding, in a substantially vertical direction, between: (1) a second-door closed position in which the second sliding door prevents users from accessing an interior portion of the second compartment; and (2) a second-door open position in which the second sliding door allows users to access the interior portion of the second compartment.

A dispenser according to a further embodiment of the invention comprises: (1) a compartment that defines both an interior portion and an opening through which a user may access the interior portion; (2) a sliding door that is adapted to selectively restrict access to the compartment by sliding between a door closed position, in which the sliding door prevents users from accessing the interior portion of the compartment, and a door open position, in which the sliding door allows users to access the interior portion of the compartment; (3) a door support that is adapted to support the sliding door when the sliding door is in the door closed position, the door support being adapted to be moved from a first position in which the door support is positioned to support the door when the door is in the door closed position, and a second position in which the door support is not positioned to support the door when the door is in the door closed position; and (4) a drive mechanism that is adapted to move the sliding door from the door closed position to an intermediate position in which the door support is out of supporting engagement with the sliding door.

A method of dispensing items according to one embodiment of the invention comprises the steps of: (1) providing a first door that is adapted to selectively restrict access to a first set of one or more items by sliding in a first substantially vertical direction relative to the dispenser; and (2) providing a second door that is adapted to selectively restrict access to a second set of one or more items by sliding in a second substantially vertical direction relative to the dispenser, the second substantially vertical direction being substantially opposite the first substantially vertical direction.

A drive mechanism according to one embodiment of the invention comprises: (1) a drive assembly; and (2) a door linking assembly that is configured to be moved between: (a) a first position, in which the door linking assembly is positioned to link the sliding door to the drive assembly and thereby allow the drive assembly to slide the door relative to the enclosure; and (b) a second position, in which the door linking assembly is positioned to prevent a user from moving the sliding door into an open position. In one embodiment of the invention, the drive assembly comprises a first drive subassembly and a second drive subassembly, and the door linking assembly links the sliding door to both the first drive subassembly and the second drive subassembly when the door linking assembly is in the first position. In a particular embodiment of the invention, the first and second drive subassemblies are disposed adjacent opposite lateral sides of the sliding door.

BRIEF DESCRIPTION OF THE DRAWINGS

Figure 1A:
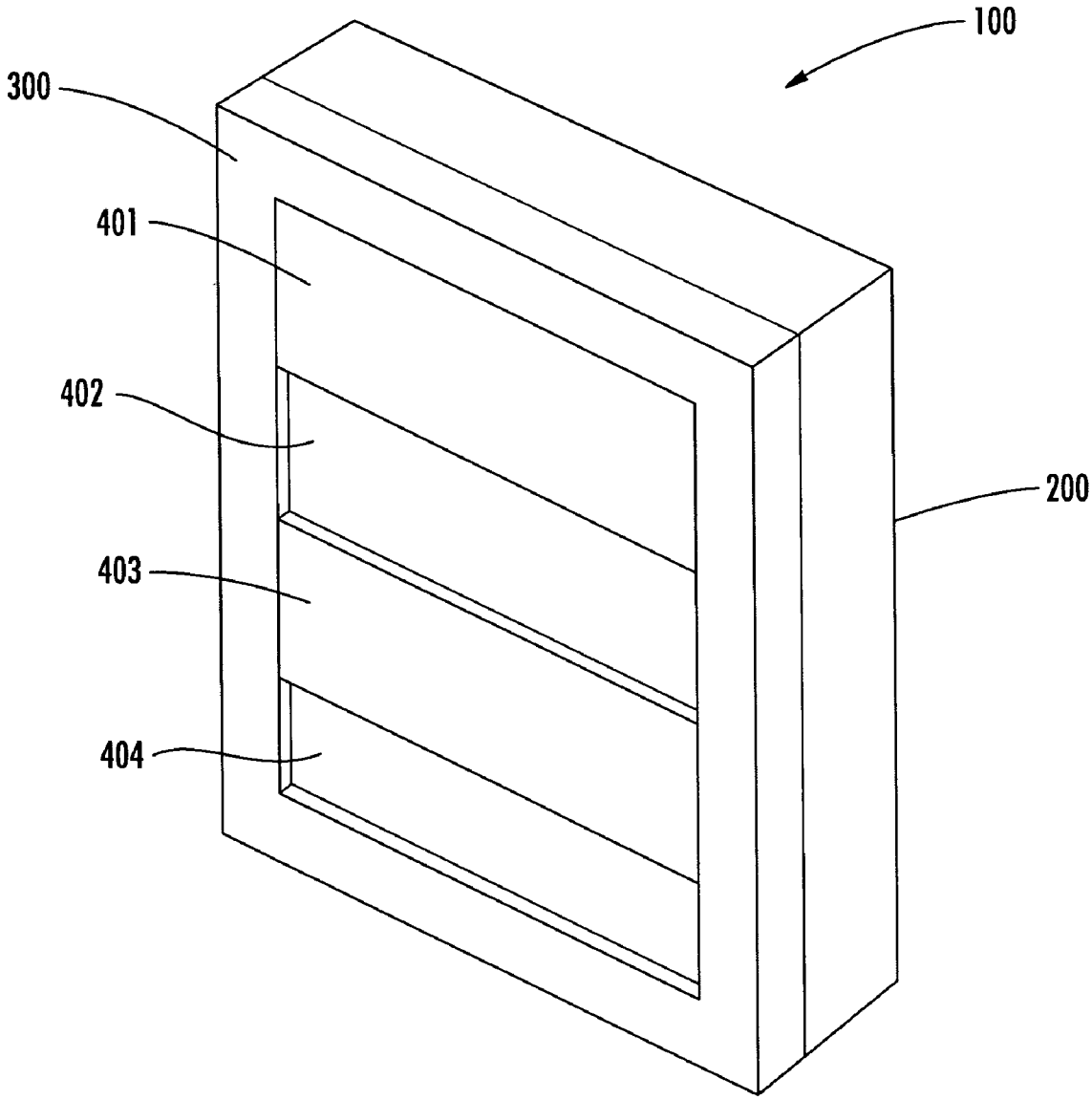

Having thus described the invention in general terms, reference will now be made to the accompanying drawings, which are not necessarily drawn to scale, and wherein:

FIG. 1A is a perspective view of a dispenser according to one embodiment of the invention. The dispenser's user doors are shown closed.

Figure 1B:
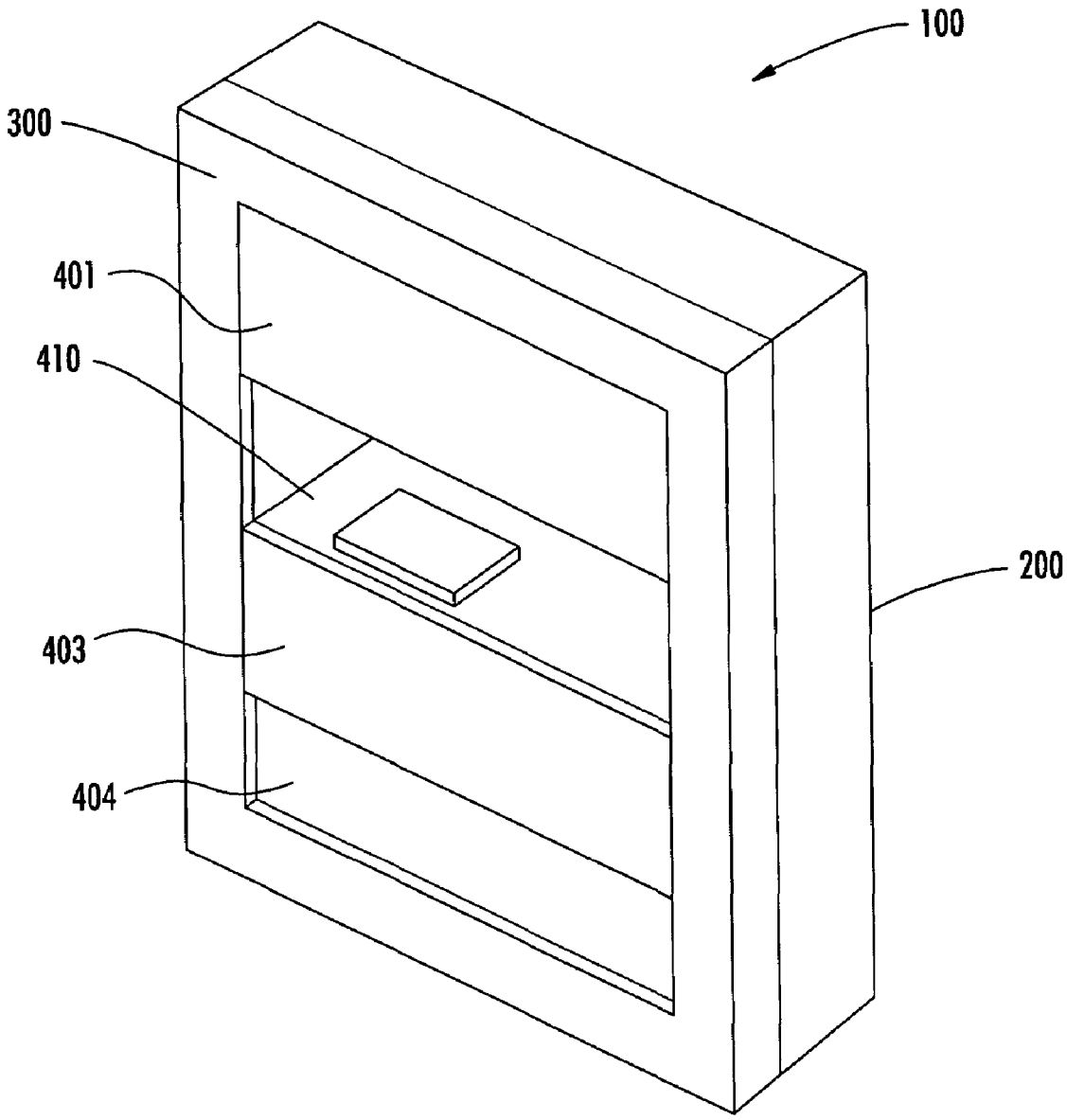

FIG. 1B is a perspective view of the dispenser of FIG. 1A in which one of the dispenser's user doors is shown open.

Figure 2:
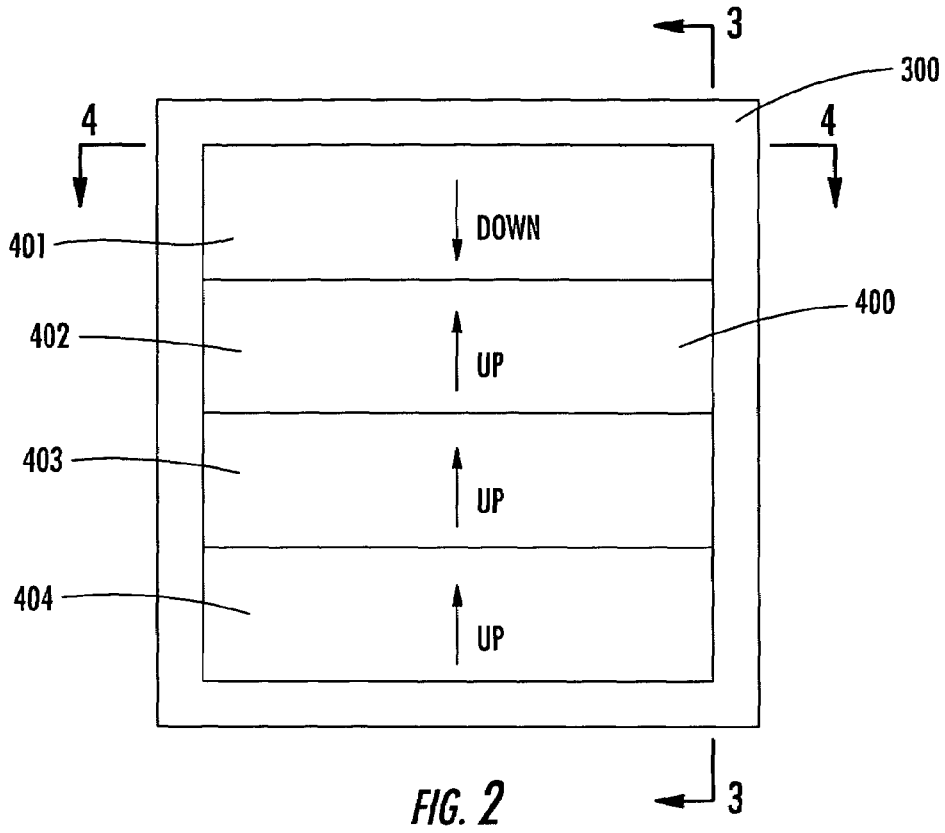

FIG. 2 is a front view of the dispenser of 1A. This figure shows the direction that each of the user doors moves when opening according to one embodiment of the invention.

Figure 3:
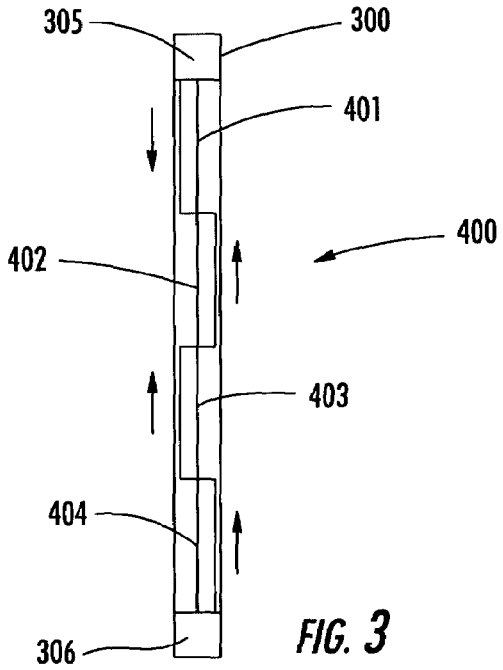

FIG. 3 is a cross-sectional side view of the main door of the dispenser of FIG. 1A taken about Section 3—3 of FIG. 2.

Figure 4:
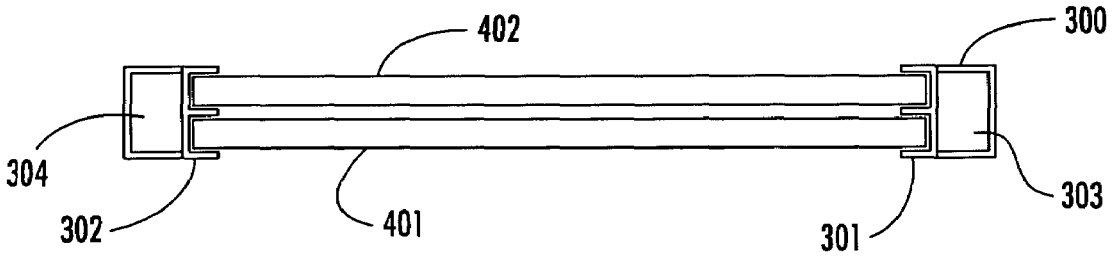

FIG. 4 is a cross-sectional top view of the main door of the dispenser of FIG. 1A taken about section 4—4 of FIG. 2.

Figure 5:
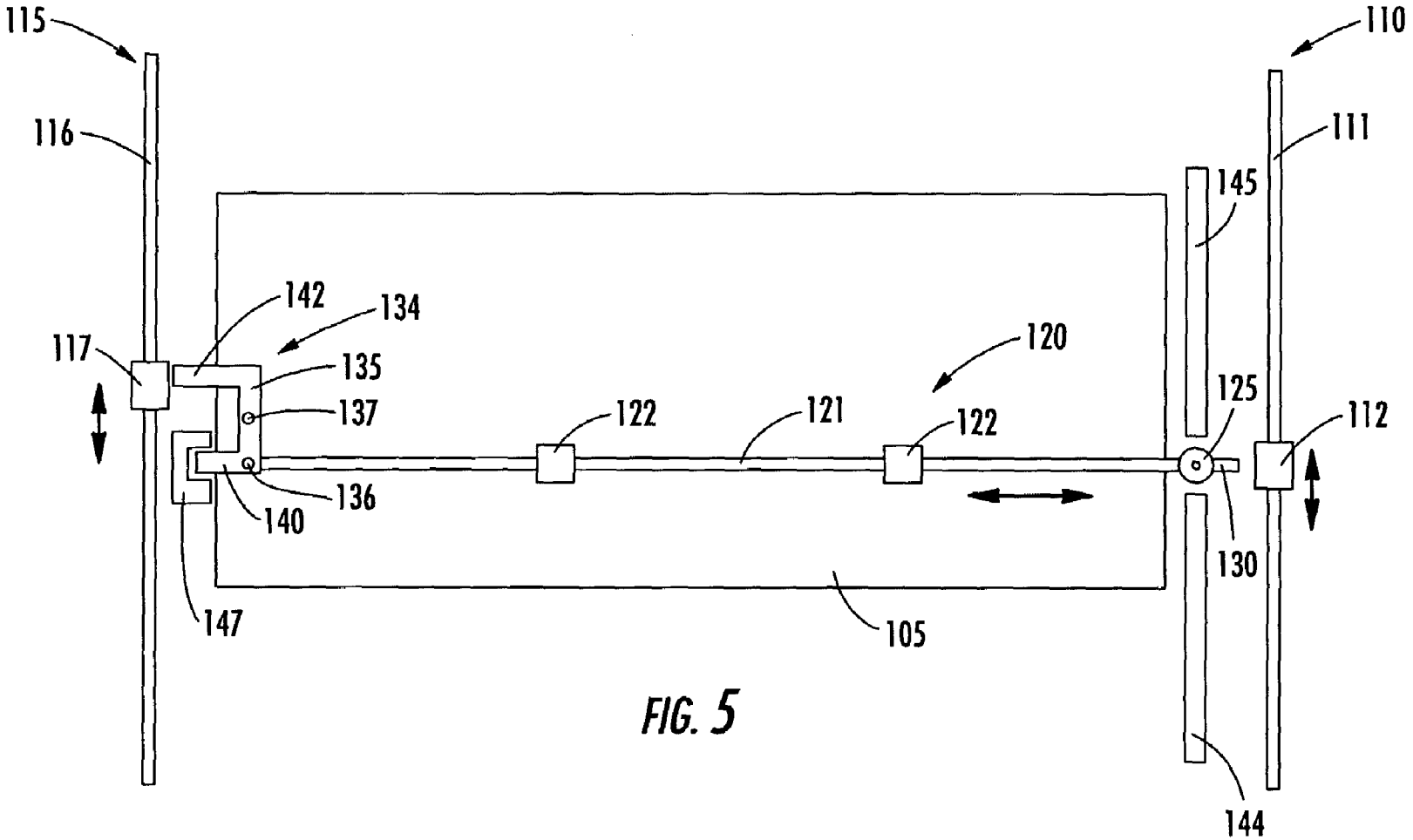

FIG. 5 is a schematic view of a drive/locking system according to one embodiment of the invention. This figure shows the system in a closed and locked configuration.

Figure 6:
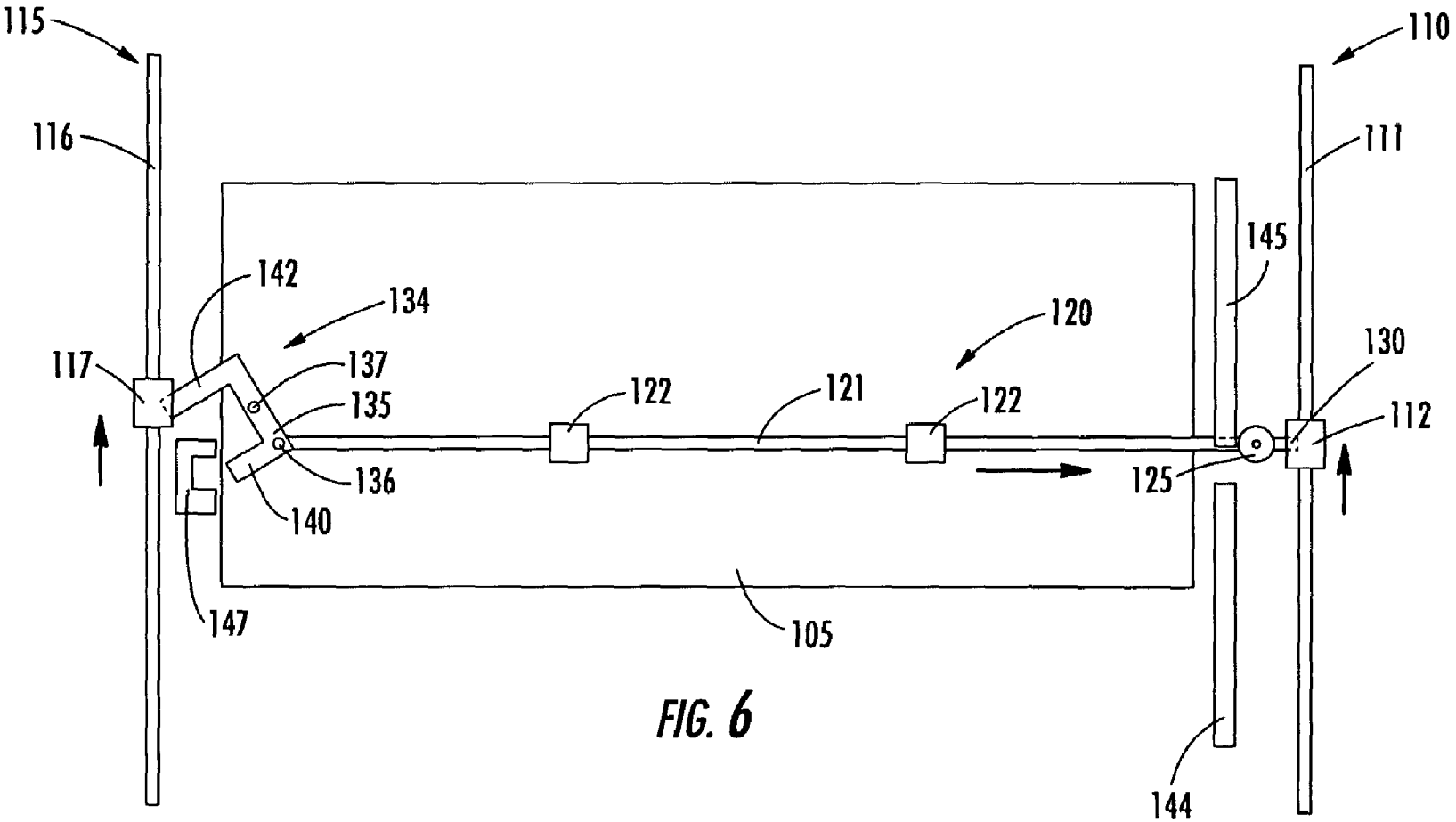

FIG. 6 is a schematic view of the drive/locking system of FIG. 5 in which the system is in a substantially closed and unlocked configuration.

Figure 7:
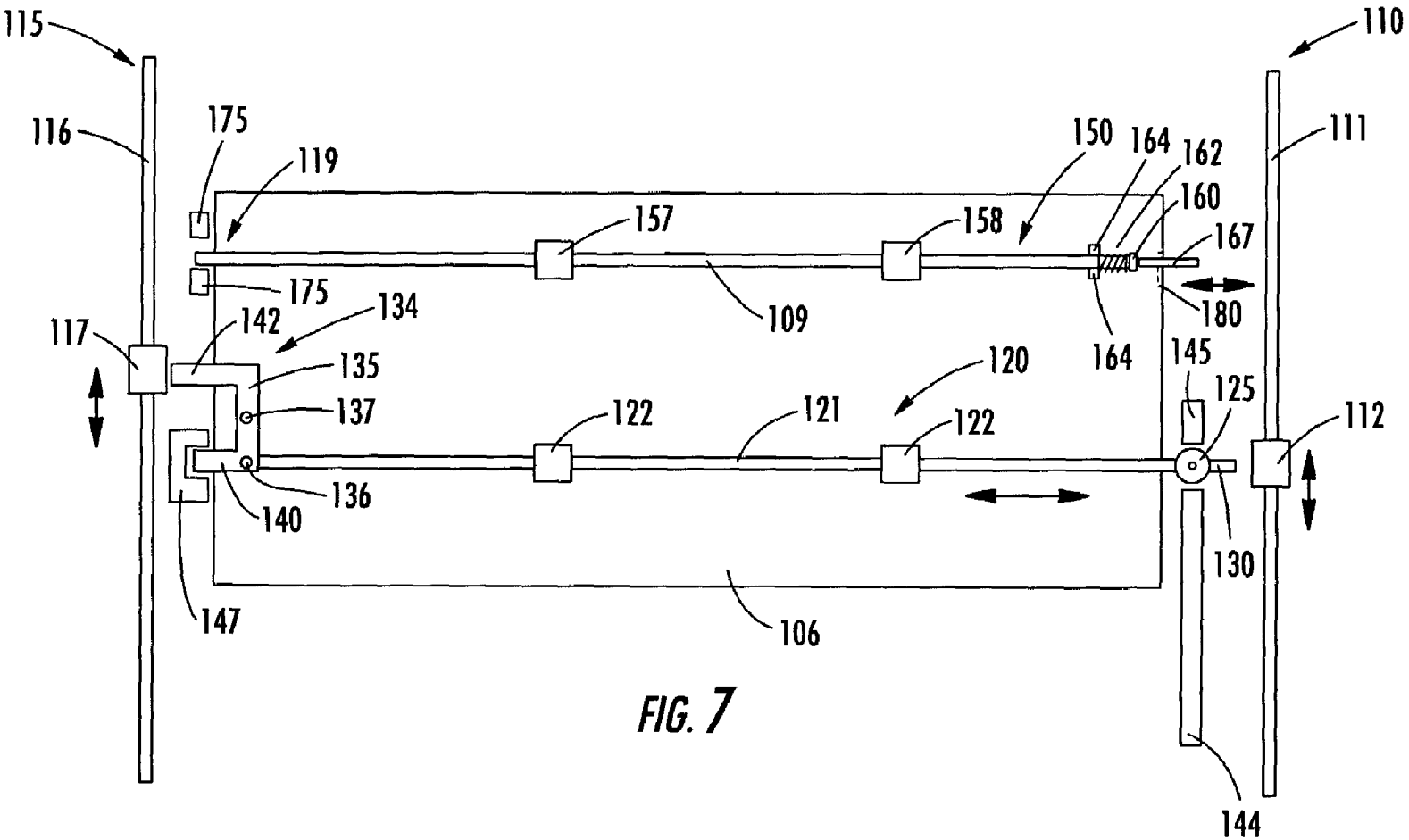

FIG. 7 is a schematic view of a drive/locking system according to another embodiment of the invention in which the system is in a closed and locked configuration.

Figure 8:
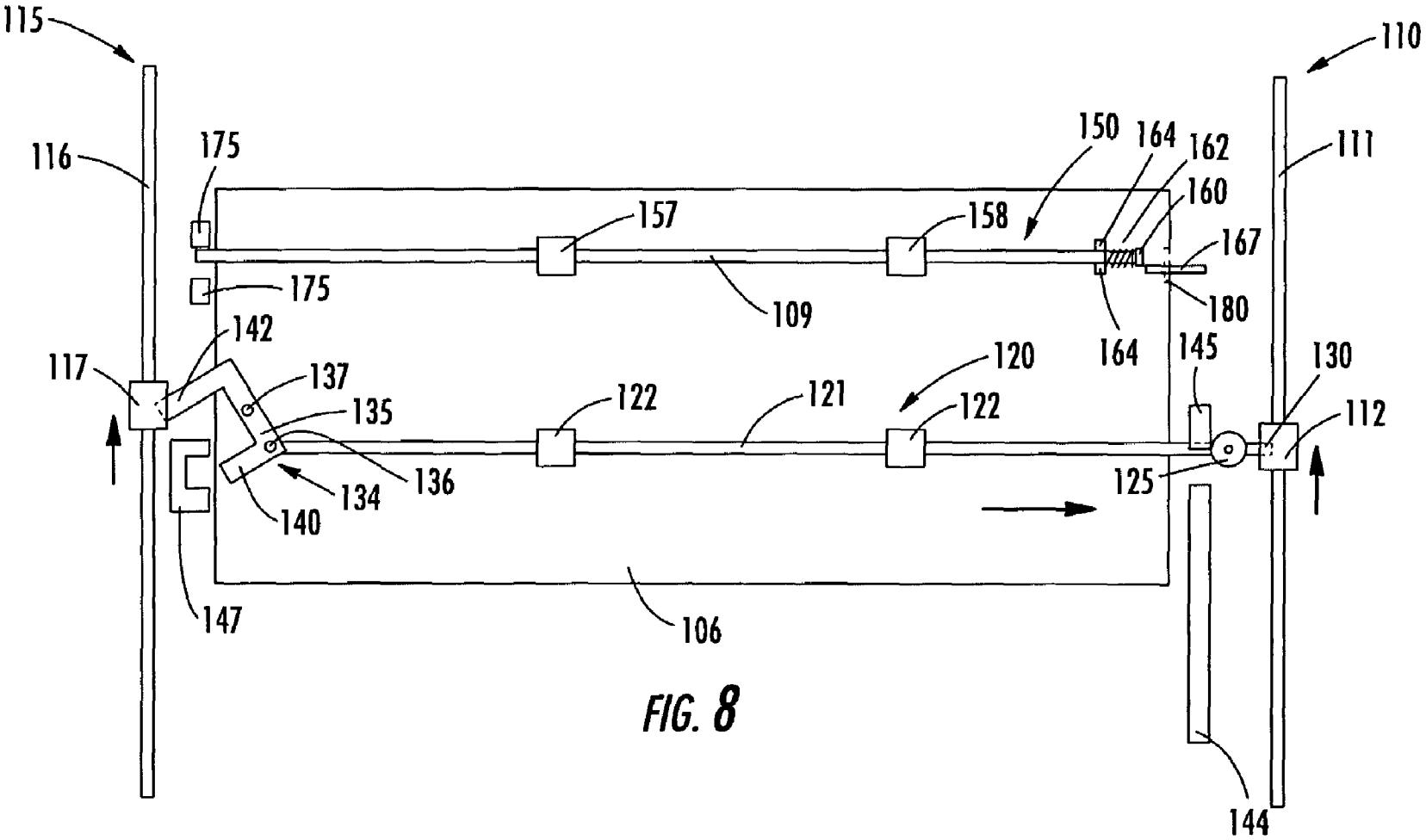

FIG. 8 is a schematic view of the drive/locking system of FIG. 7 in which the system is in a substantially closed and unlocked configuration and in which a support mechanism is in a first configuration.

Figure 9:
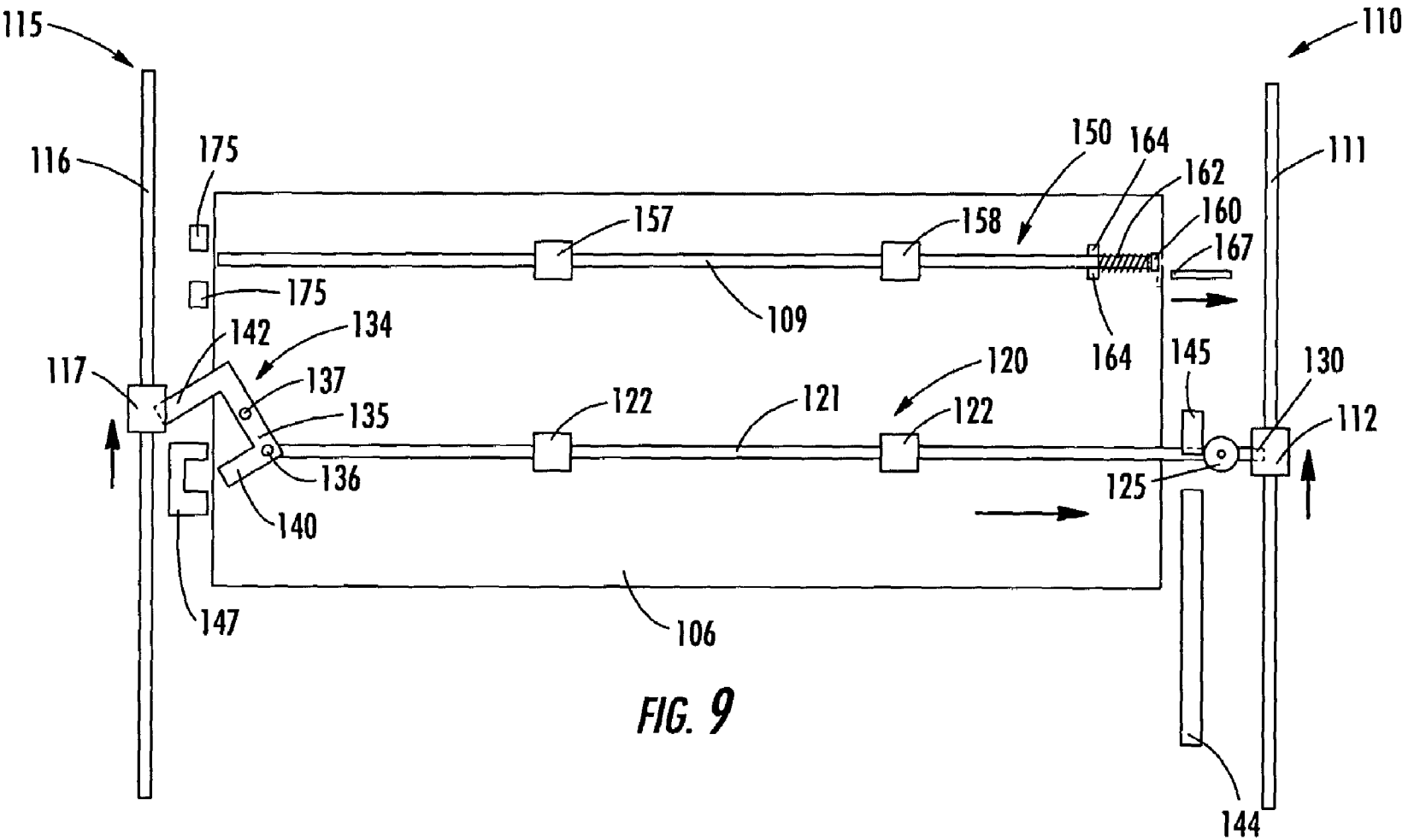

FIG. 9 is a schematic view of the drive/locking system of FIG. 7 in which the system is in a substantially closed and unlocked configuration and in which the support mechanism is in a second configuration.

Figure 10:
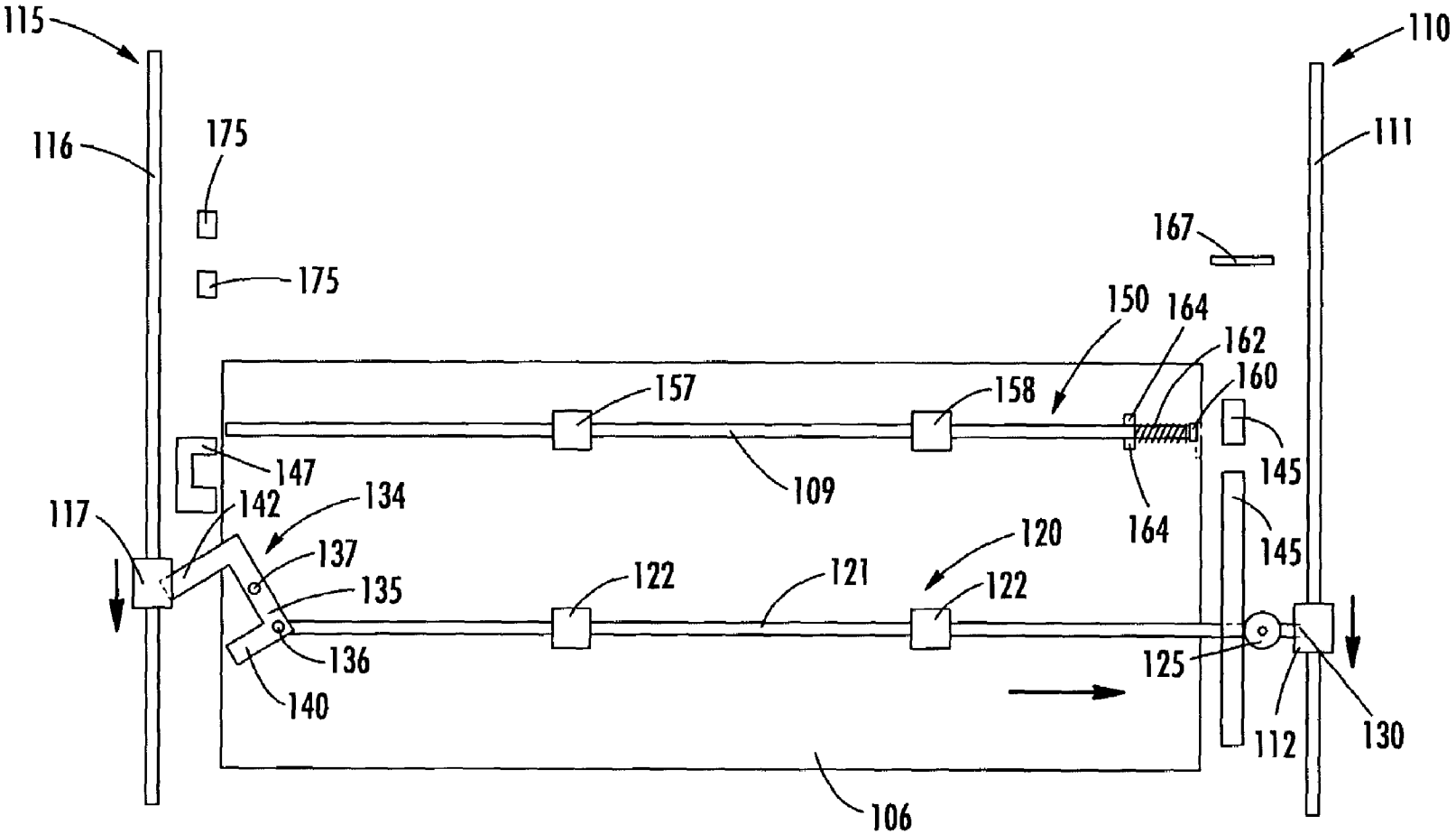

FIG. 10 is a schematic view of the drive/locking system of FIG. 7 in which the user door is moving into a substantially open and unlocked configuration.

Figure 11:
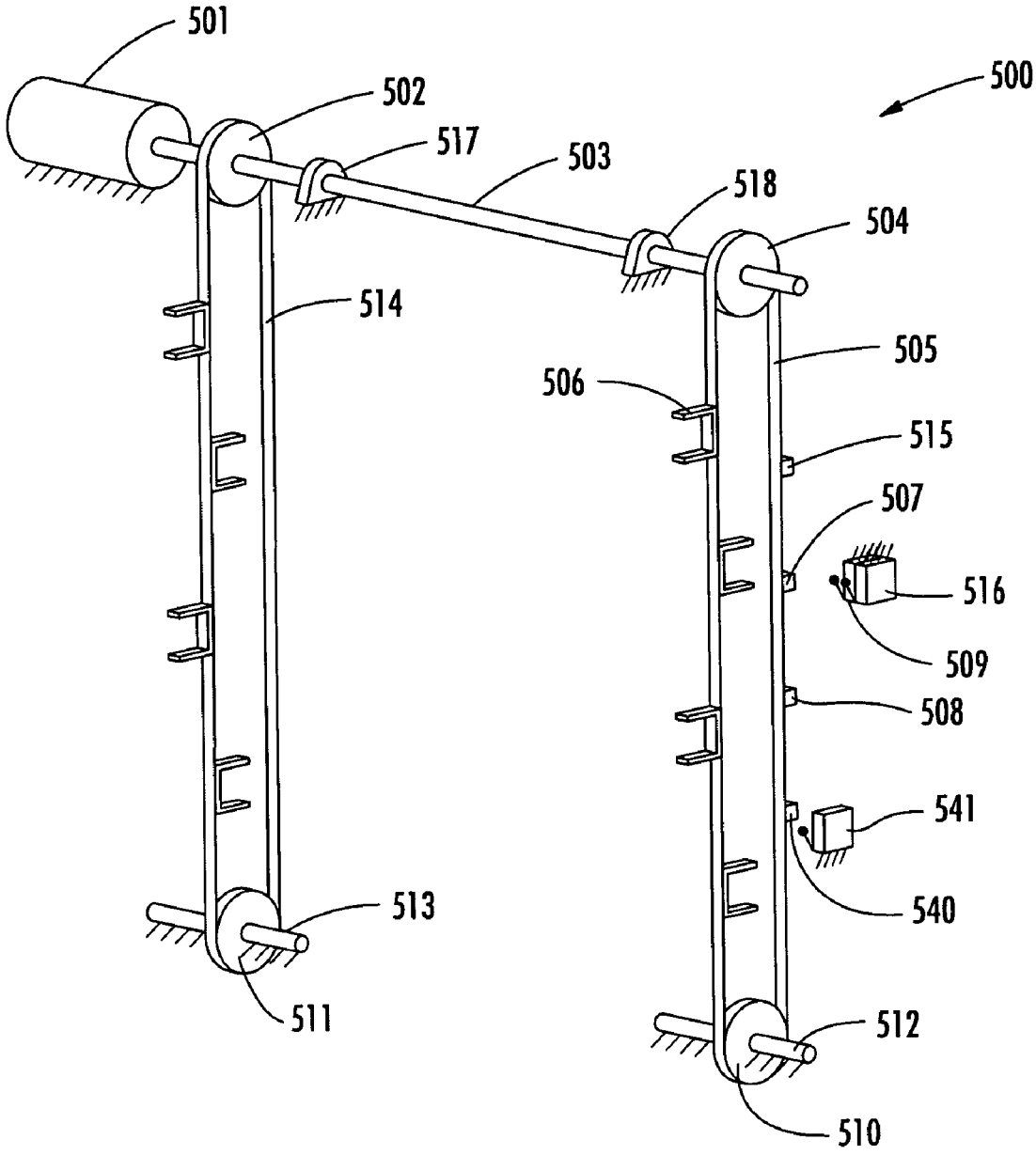

FIG. 11 is a perspective view of a drive system according to one embodiment of the invention.

Figure 12A:
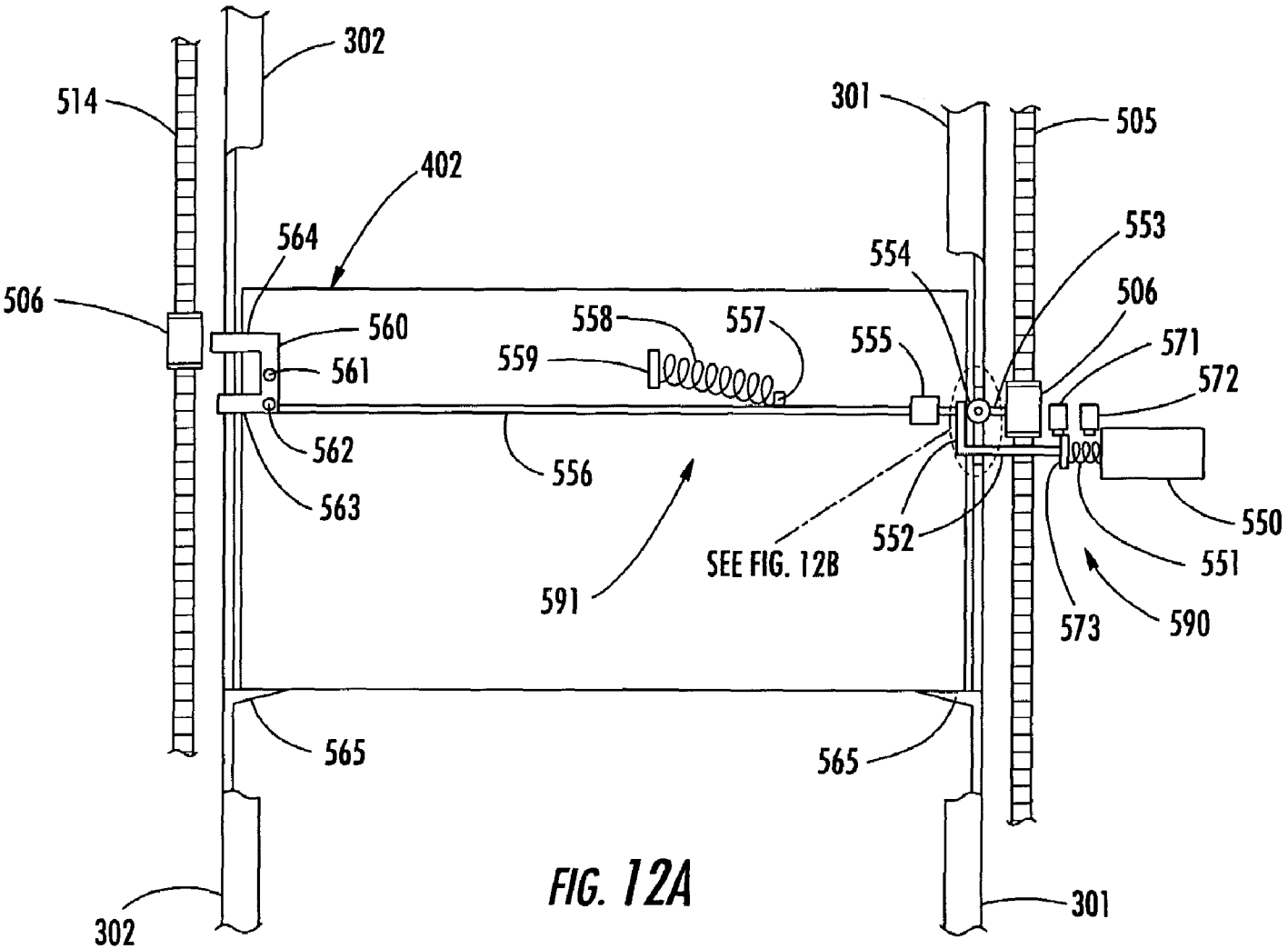

FIG. 12A is a front view of a drive/locking system according to a particular embodiment of the invention in which the user door is in a closed, locked configuration.

Figure 12B:
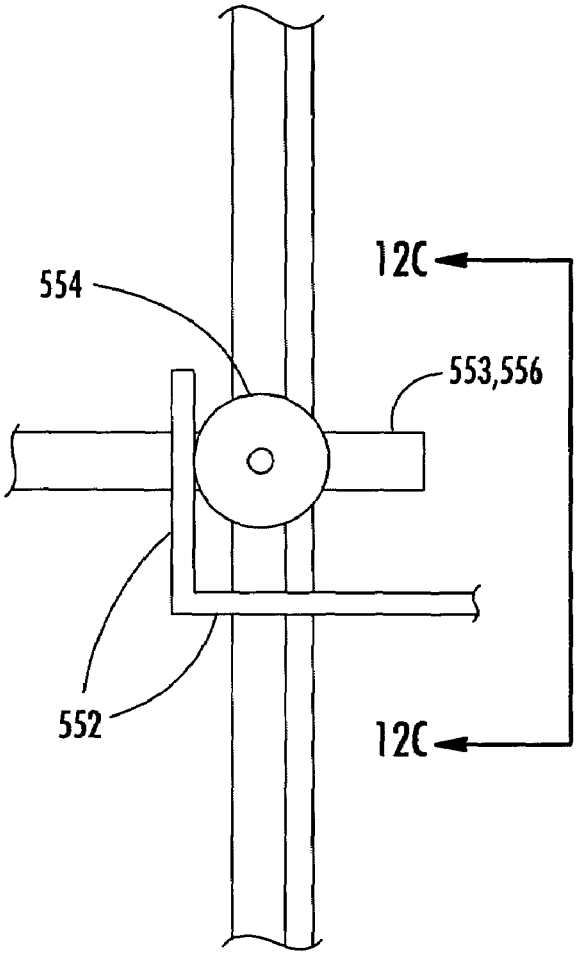

FIG. 12B is an enlarged front view of the wheel shown in FIG. 12A.

Figure 12C:
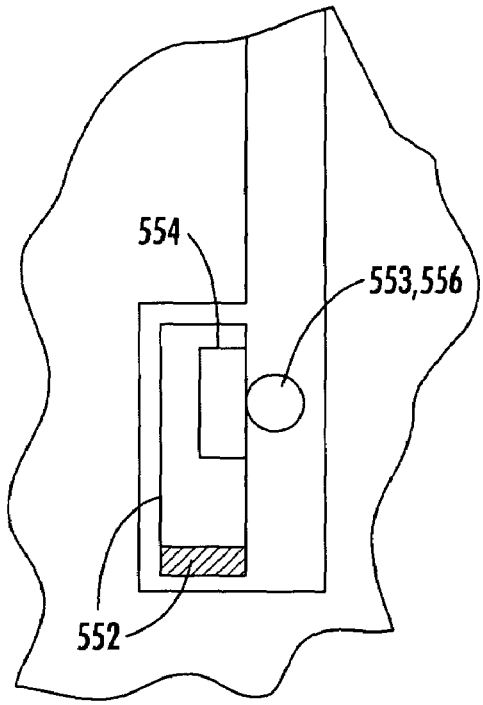

FIG. 12C is an enlarged cross-sectional side view of the wheel shown in FIGS. 12A and 12B taken about section 12C—12C of FIG. 12B.

Figure 13A:
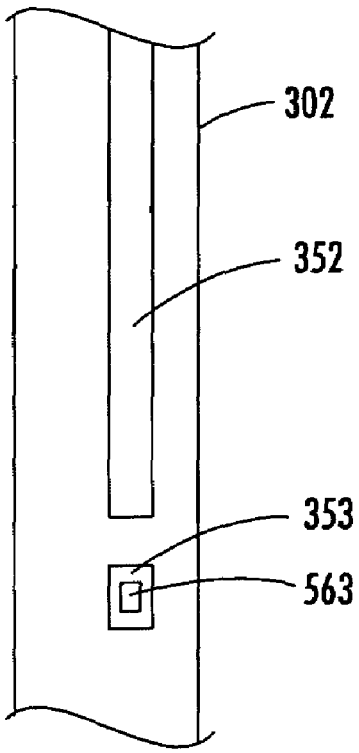

FIG. 13A is side view of a left track of the dispenser shown in FIG. 12A.

Figure 13B:
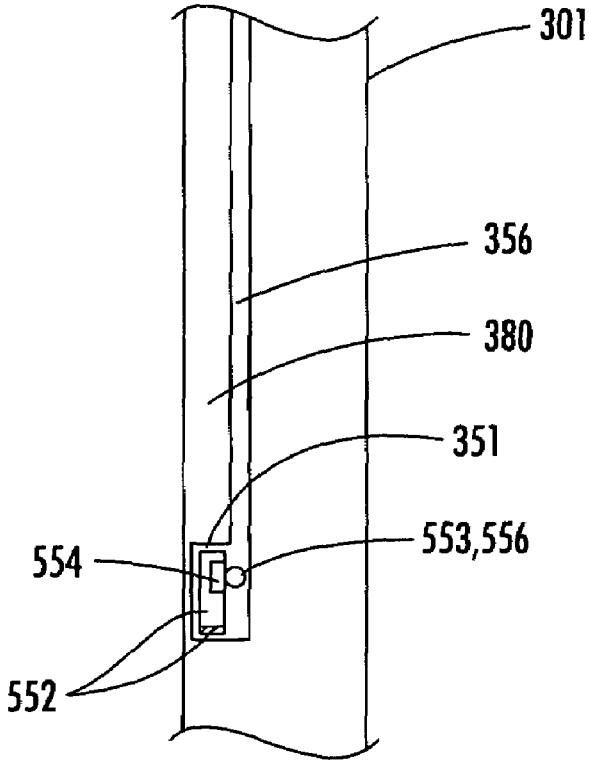

FIG. 13B is a side view of the right track of the dispenser shown in FIG. 12A.

Figure 14A:
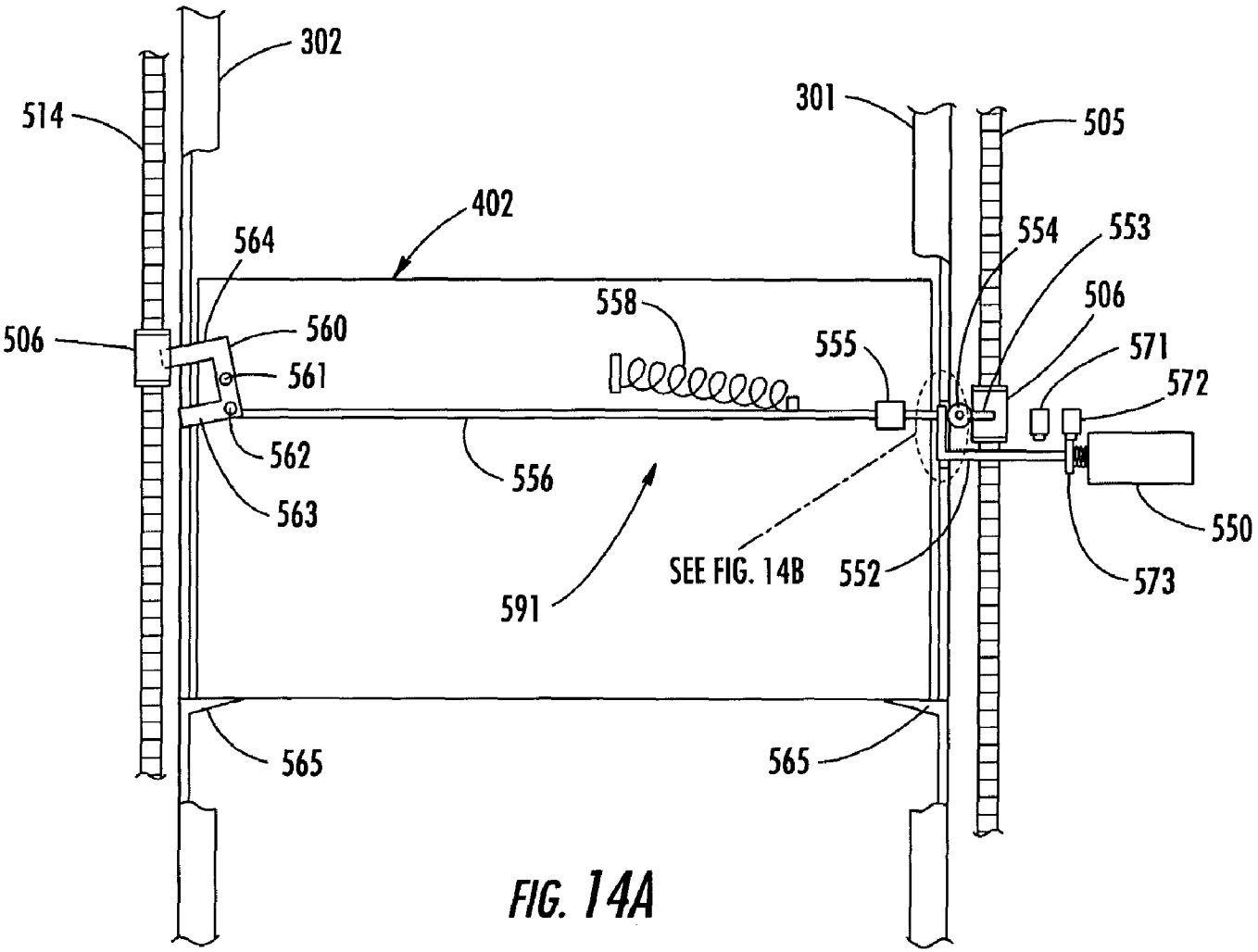

FIG. 14A is a front view of a drive/locking system according to a particular embodiment of the invention in which the user door is in a closed, unlocked configuration.

Figure 14B:
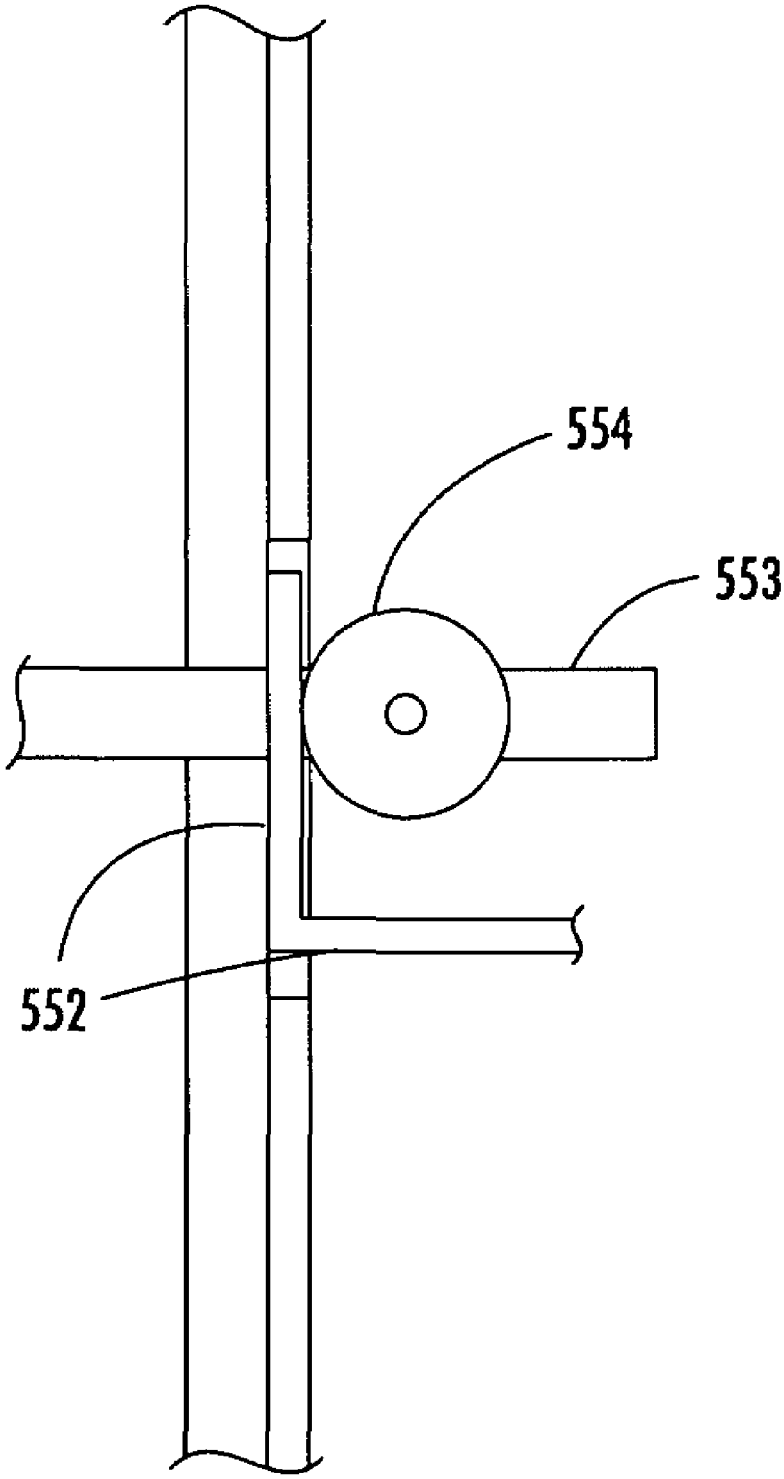

FIG. 14B is an enlarged front view of the wheel shown in FIG. 14A.

Figure 15:
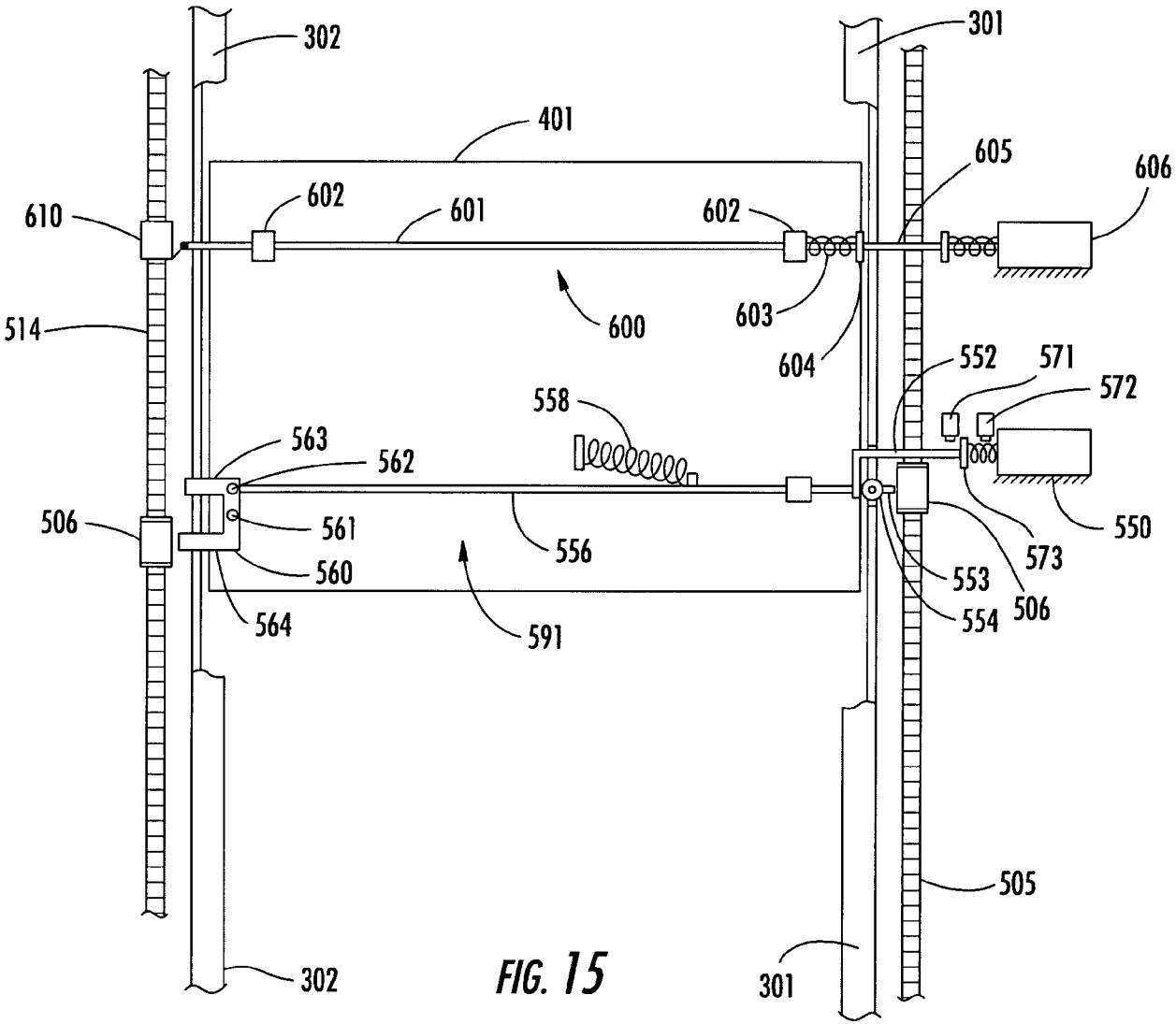

FIG. 15 is a front view of a locking mechanism according to a further embodiment of the invention in which the user door is in a closed, locked configuration.

Figure 16A:
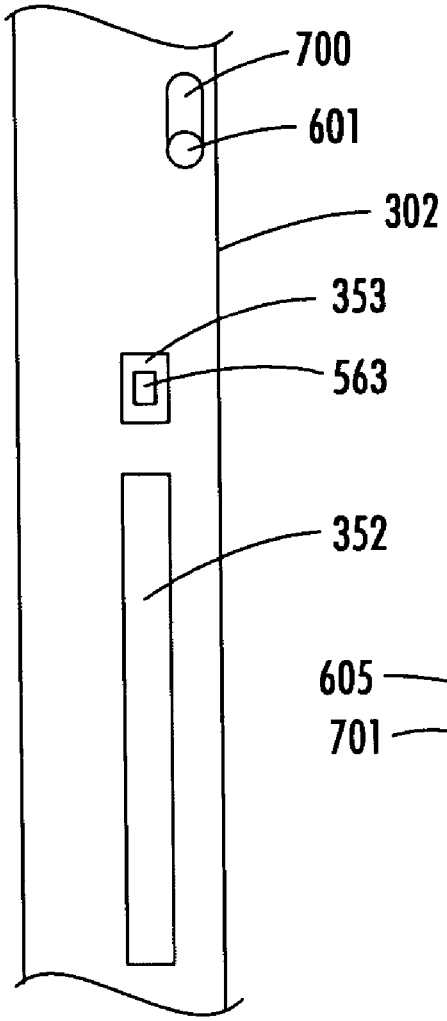

FIG. 16A is a side view of the left track of the dispenser shown in FIG. 15.

Figure 16B:
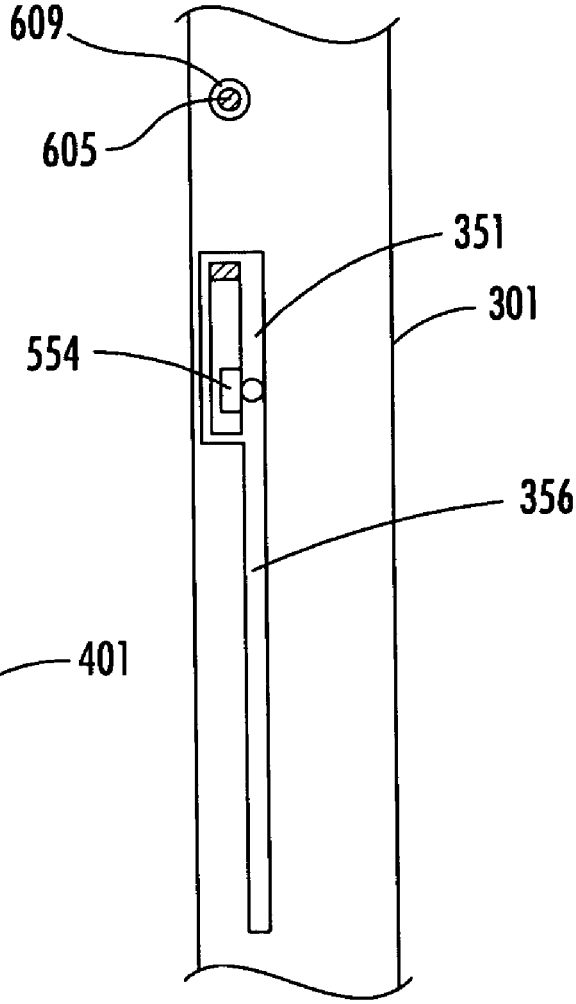

FIG. 16B is a cross-sectional side view of the right track of the dispenser shown in FIG. 15 taken about a section that extends vertically between the right drive chain and linking rod shown in FIG. 15.

Figure 17:
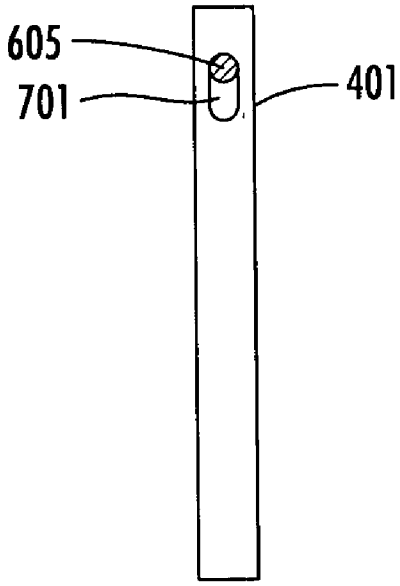

FIG. 17 is a cross-sectional side view of the right side of the sliding user door shown in FIG. 15 taken about a section that extends vertically between the stopper and right track of the dispenser shown in FIG. 15.

Figure 18:
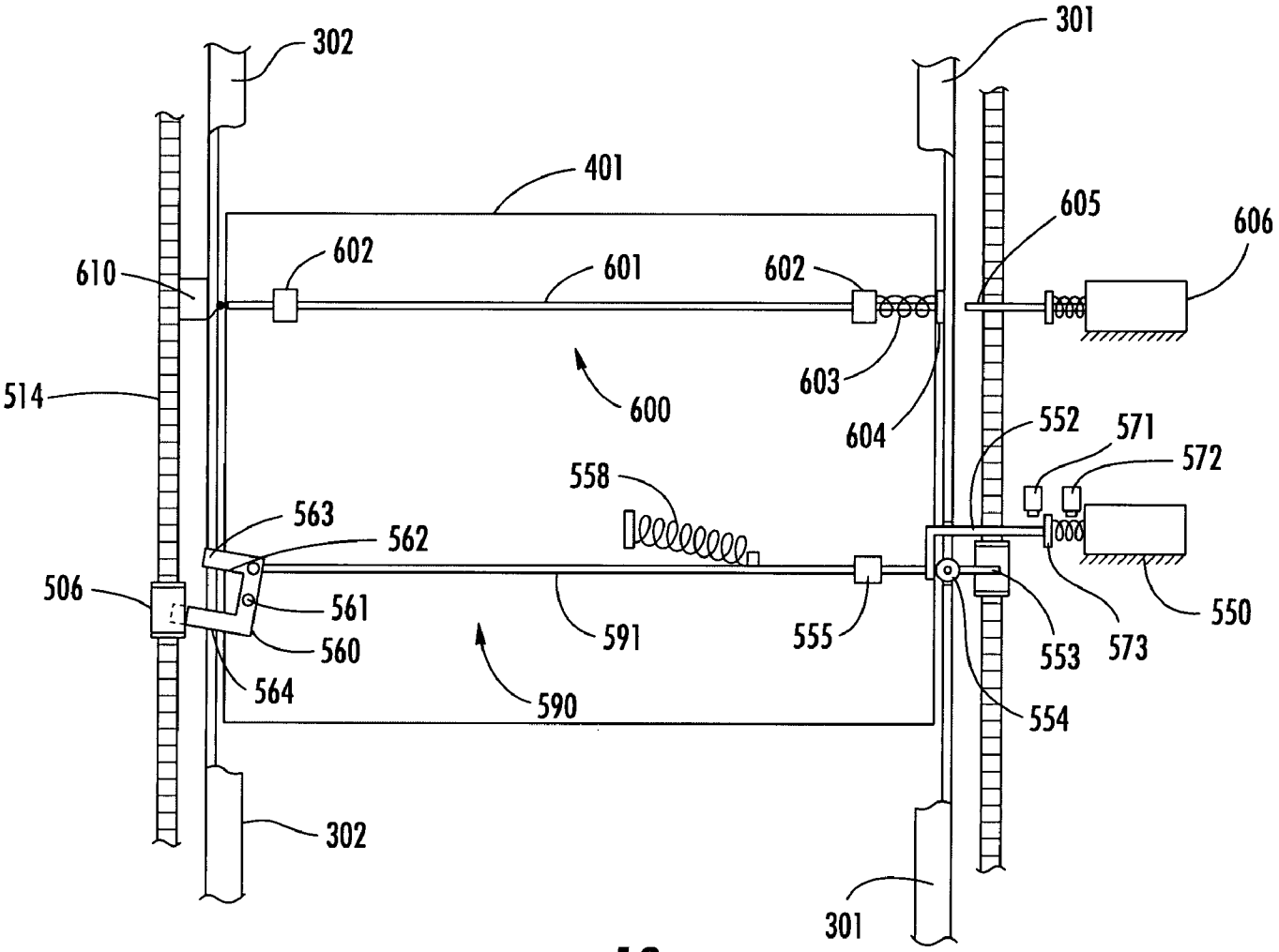

FIG. 18 is a front view of the locking mechanism of FIG. 15 in which the user door is in a closed, unlocked configuration.

DETAILED DESCRIPTION OF THE INVENTION

The present invention will now be described more fully hereinafter with reference to the accompanying drawings, in which various embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Overview of the General Structure of the Dispenser

FIGS. 1–10 provide an overview of a dispenser according to a particular embodiment of the invention. More particularly, FIG. 1A depicts a dispenser 100 that comprises a body portion 200 and a main door 300 that is preferably mounted to move relative to the body portion 200 (e.g., about hinges) to permit access to one or more interior compartments defined by the body portion 200. This main door 300 is typically locked during operation and used to provide dispenser operators simultaneous access to all of the dispenser's interior compartments (e.g., by opening the main door 300).

The main door 300 comprises one or more sliding user doors, which are, in one embodiment of the invention, arranged in a substantially vertical array. For example, the dispenser 100 depicted in FIG. 1A includes four user doors 401–404 that are arranged in a substantially vertical array. In one embodiment of the invention, each user door 401–404 is configured to selectively restrict access to a particular compartment defined by the dispenser 100. For example, as may be understood from FIGS. 1A and 1B, the second user door 402 may be moved between: (1) a closed position (shown in FIG. 1A) in which the second user door 402 prevents users from accessing an interior portion of the dispenser (e.g., an interior compartment); and (2) an open position (shown in FIG. 1B) in which the second user door 402 does not prevent users from accessing an interior portion (e.g., a compartment 410) of the dispenser. In one embodiment of the invention, one or more (and preferably all) of the user doors 401–404 are adapted to slide between an open and a closed position.

As may be understood generally from FIGS. 1–3, in one embodiment of the invention, the uppermost user door (in this case, first user door 401) is configured to open by sliding in a first direction (e.g., downwardly) and one or more of the other user doors (in this case, the second, third, and fourth user doors 402–404) are configured to move in a second direction that is substantially opposite to the first direction (e.g., in this case, upwardly). This is due to the fact that the upward movement of the first user door 401 is inhibited by the top of the dispenser 300.

To facilitate the movement (e.g., sliding movement) of the various user doors 401–404, these user doors 401–404 may be mounted to slide along at least two different paths. For example, in the embodiment of the invention shown in FIGS. 3 and 4, the first and third user doors 401, 403 are mounted to slide along a first substantially vertical path, and the second and fourth user doors 402, 404 are mounted to slide along a second substantially vertical path adjacent the first substantially vertical path. In this embodiment of the invention, the first and second paths are defined by substantially vertical tracks disposed adjacent the opposite sides of the user doors 401–404. Also, as may be understood from FIG. 4, in this embodiment of the invention, the first and second vertical paths are each substantially planar and are substantially parallel to, and offset from, each other.

As may be understood from FIG. 3, in one embodiment of the invention, the user doors 401–404 are arranged so that each particular user door 401–404, and at least one other user door 401–404 adjacent that particular user door, are adapted to slide along different paths. For example, in the embodiment of the invention shown in FIG. 3, the first user door 401 and the second user door 402 (which is adjacent the first user door 401) are configured to slide along different paths. This allows the first user door 401 to slide from a closed position in which the first user door 401 is above the second user door 402, to an open position in which the first user door 401 is immediately adjacent to and co-facing the second user door 402. In one embodiment of the invention, when the first user door 401 is in the open position, the first and second user doors 401, 402 are substantially vertically aligned and a rear portion of the first user door 401 is adjacent a front portion of the second user door 402.

Similarly, in one embodiment of the invention, the dispenser 100 is configured so that the second user door 402 may slide from a closed position in which the second user door 402 is immediately below the first user door 401, to an open position in which the second user door 402 is immediately adjacent to and co-facing the first user door 401. In a particular embodiment of the invention, when the second user door 402 is in this open position, the first and second user doors 401, 402 are substantially horizontally aligned and a rear portion of the first user door 401 is adjacent a front portion of the second user door 402.

In one embodiment of the invention, when the first and second user doors 401, 402 are both in a closed position, the first and second user doors 401, 402 are positioned so that a user can not access items within the interior of the dispenser by reaching between the first and second user doors 401, 402.

Turning again to FIG. 3, in one embodiment of the invention, the dispenser 100 is configured so that the third user door 403 may slide from a closed position in which the third user door 403 is below the second user door 402, to an open position in which the third user door 403 is immediately adjacent to and co-facing the second user door 402. In one embodiment of the invention, when the third user door 403 is in this open position, the second and third user doors 402, 403 are substantially horizontally aligned and a rear portion of the third user door 403 is adjacent a front portion of the second user door 402.

Also, in one embodiment of the invention, the dispenser 100 is configured so that the fourth user door 404 may slide from a closed position in which the fourth user door 404 is immediately below the third user door 403, to an open position in which the fourth user door 404 is immediately adjacent to and co-facing the third user door 403. In one embodiment of the invention, when the fourth user door 404 is in this open position, the third and fourth user doors 403, 404 are substantially horizontally aligned and a rear portion of the third user door 403 is adjacent a front portion of the fourth user door 404.

As may be understood from FIGS. 1–3 and the above discussion, in one embodiment of the invention, the various user doors 401–404, and a housing (e.g., a housing formed by the dispenser's body portion 200 and the dispenser's main door 300) cooperate to restrict access to one or more compartments defined by the dispenser 100. It should be understood that, while this housing is described in this specification as including both the dispenser's body portion 200 and the dispenser's main door 300, this housing may take many forms. For example, the housing may be a single integrated unit.

Overview of User Door Drive and Locking Mechanisms

FIGS. 5–10 depict various drive and locking mechanisms according to various embodiments of the invention. More particularly, FIGS. 5 and 6 depict a drive and locking mechanism that is particularly suitable for use with the second, third, and fourth user doors 402–404 shown in FIG. 1. Such drive and locking mechanisms are especially suitable, for example, for use with sliding user doors that are configured for sliding upwardly from a closed to an open position (i.e., for upwardly-opening sliding user doors), or for relatively lightweight doors.

FIGS. 7–10 depict various drive and locking mechanisms that are particularly suitable for use with sliding user doors that are configured for sliding downwardly from a closed to an open position (i.e., for downwardly-opening sliding user doors). For example, these drive and locking mechanisms are well suited for use with the first user door 401 of FIG. 1.

Turning to FIGS. 5 and 6, these figures depict a drive and locking mechanism according to one embodiment of the invention that is positioned for use with a user door 105. The drive and locking mechanism comprises a drive mechanism that comprises a first drive subassembly 110 that is positioned adjacent a first lateral side of the user door 105, and a second drive subassembly 115 that is positioned adjacent a second lateral side of the user door 105. The drive and locking mechanism further comprises a door linking assembly 120 that comprises an elongate linking member (e.g., linking rod 121) and a rotatable member 134. The drive and locking mechanism may also comprise a blocking member, which may be, for example, a wheel 125 or any other suitably shaped member. In a particular embodiment of the invention, the wheel 125 is adjacent the first lateral side of the user door 105 and rotatable member 134 is adjacent the second lateral side of the user door 105.

As may be understood from FIG. 5, the linking rod 121 is preferably mounted to slide laterally relative to the user door 105. For example, in the embodiment of the invention shown in FIG. 5, the linking rod 121 is slideably mounted to the user door 105 by one or more linking rod mounts 122.

Similarly, the rotatable member 134 is preferably mounted to rotate relative to the user door 105. For example, in the embodiment of the invention shown in FIG. 5, the rotatable member 134 is rotatably mounted to the door by a mounting pin 137 and is substantially free to rotate about an axis defined by the mounting pin 137.

As may be understood from FIG. 5, in one embodiment of the invention, the rotatable member 134 comprises a first elongate member 140 and a second elongate member 142 that is, in one embodiment of the invention, substantially parallel to the first elongate member 140. The rotatable member 134 may further comprise an intermediate member 135 that extends between the first and second elongate members 140, 142. In the embodiment of the invention shown in FIG. 5, the rotatable member 134 is substantially U-shaped. However, the rotatable member 134 may alternatively be V-shaped, W-shaped, or any other suitable shape.

As noted above, in one embodiment of the invention, the rotatable member 134 is configured to rotate about a mounting pin 137. In addition, in a particular embodiment of the invention, the rotatable member 134 is linked so that moving the linking rod 121 in a first lateral direction causes the rotatable member 134 to rotate in a counterclockwise direction, and so that moving the linking rod 121 in a second lateral direction causes the rotatable member 134 to rotate in a clockwise direction. In one embodiment of the invention, the second direction is substantially opposite the first direction.

As may be understood from FIG. 5, in one embodiment of the invention, the linking rod 121 is linked to wheel 125, (which may be referred to as a blocking member), which, as discussed in greater detail below, serves to restrict the vertical movement of the user door 105 when the wheel 125 (which may be referred to as a type of "blocking member") is in a locked position, and which may also serve to facilitate the vertical movement of the user door 105 when the user door 105 is in an unlocked position. In the embodiment of the invention shown in FIG. 5, the blocking member 125 is a wheel that is rotatably mounted to the linking rod 121.

In one embodiment of the invention, the wheel 125 is attached to the linking rod 121 so that the wheel 125 is adjacent a first end of the linking rod 121. Similarly, the rotatable member 134 is mounted to the linking rod 121 so that the rotatable member's first elongate member 140 is adjacent a second end of the linking rod 121. In one embodiment of the invention, the wheel 125 is mounted to the linking rod 121 so that the wheel 125 is substantially free to rotate relative to the linking rod 121 about the wheel's central axis.

In a particular embodiment of the invention, when the door linking assembly 120 is in a first "locked" position, the rotatable member 134 is also in a locked position in which the rotatable member's first elongate member 140 extends adjacent (and preferably into a recess defined by) a first restricting member 147 (which, for example, may simply be an appropriately shaped portion of the dispenser's housing) that is adjacent a first side of the door 105. When the rotatable member 134 is in the closed position, the first restricting member 147 serves to restrict the movement of the user door 105 in the upward direction (e.g., due to the fact that the first restricting member 147 serves to physically restrict the upward movement of the first elongate member 140 and therefore the upward movement of the user door 105).

Similarly, when the door linking assembly 120 is in the first "locked" position, the wheel 125 is also in a locked position in which the wheel 125 is positioned adjacent (and preferably below) a second restricting member 145 that is adjacent the first side of the user door 105. This serves to further restrict the movement of the user door 105 in the upward direction (e.g., due to the fact that the second restricting member 145 serves to physically restrict the upward movement of the wheel 125 and therefore the upward movement of the user door 105).

As will be understood from FIG. 5, when the door linking assembly 120 is in the "locked" position, the rotatable member's second elongate member 142 is out of engagement with the first drive subassembly 115 and the linking rod 121 (e.g., the first linking member end portion 130) is out of engagement with the second drive subassembly 110. This serves to further prevent movement of the user door 105 by maintaining the user door 105 disengaged from the drive mechanism when the door linking assembly 120 is in the "locked" position.

In one embodiment of the invention, the door linking assembly 120 includes a biasing mechanism, such as a spring (not shown), for continuously biasing the door linking assembly 120 towards the "locked" position. For example, the door linking assembly 120 may include a spring (not shown) that is attached and configured for biasing the linking rod 121 so that additional force is required to move the linking rod 121 from the "locked" to the "unlocked" position, and so that additional force is also required to maintain the linking rod 121 in the "unlocked" position.

In a further embodiment of the invention, and as shown in FIG. 6, when the door linking assembly 120 is in a second, "unlocked" position, the rotatable member 134 is also in an unlocked position in which the first restricting member 147 does not substantially obstruct the upward movement of the rotatable member's first elongate member 140. Also, in a particular embodiment of the invention, when the door linking assembly 120 is in the "unlocked" position, the rotatable member's second elongate member 142 is in driving engagement with the second drive subassembly. For example, in the embodiment of the invention shown in FIG. 6, the second elongate member 142 engages a second door movement bracket 117, which places the door linking assembly 120 into driving engagement with the second drive subassembly 115.

Similarly, when the door linking assembly 120 is in the "unlocked" position, the wheel 125 is also in an unlocked position in which the wheel 125 is positioned so that the second restricting member 145 does not substantially obstruct the upward movement of the wheel 125. In one embodiment of the invention, when the door linking assembly 120 is in the "unlocked" position, the wheel 125 is positioned to roll along an exterior surface of the second restricting member 145. Also, in a particular embodiment of the invention, when the door linking assembly 120 is in the "unlocked position", a portion of the linking rod 121 (e.g., an end portion 130) is positioned to engage a first door movement bracket 112, which places the door linking assembly 120 into driving engagement with the first drive subassembly 110.

To move the door linking assembly 120 from the locked to the unlocked position, the linking rod 121 is moved toward the first drive subassembly 110 (e.g., to the right in FIG. 5).

The linking rod 121 may be moved automatically (e.g., via an actuator) or, in an alternative embodiment, manually. This movement of the linking rod 121 causes the rotatable member 134 to rotate about the mounting pin 137 until: (1) the rotatable member's second elongate member 142 engages the second door movement bracket 117; and (2) the rotatable member's first elongate member 140 is positioned so that its upward movement is not substantially obstructed by the first restricting member 147. FIG. 6 depicts the rotatable member 134 in this "unlocked" position.

The movement of the linking rod 121 also causes the wheel 125 to move into a position in which the second restricting member 145 does not substantially obstruct the upward movement of the wheel 125. In addition, the movement of the linking rod 121 preferably positions the wheel 125 so that the wheel 125 may roll along an exterior edge of the second restricting member 145 as the user door 105 is moved from a closed to an open position. The movement of the linking rod 121 also serves to move the end 130 of the linking rod 121 into engagement with the first door movement bracket 112 (and, thus, into engagement with the first drive subassembly 110).

The user door 105 may then be opened by using the first and second drive chains 111, 116 (or other drive members) to move the first and second door movement brackets 112, 117 (and, thus, the user door 105) upwardly until the user door 105 reaches an open position. The user door 105 may then be closed by using the first and second drive chains 111, 116 (or other drive members) to move the first and second door movement brackets 112, 117 (and, thus, the user door 105) downwardly until the user door 105 reaches a closed position. Once the user door 105 is in the closed position, the linking rod 121 is moved toward the second drive subassembly 115 until the door linking mechanism 120 is again in the locked position described above.

It should be understood that one feature of the embodiment of the invention shown in FIG. 6 is that, when the door linking mechanism 120 is in the locked position, the rotatable member's first elongate member 140 and the first restricting member 147 serve to maintain the second lateral side of the user door 105 in the closed position. At the same time, the wheel 125 and the second restricting member 145 serve to maintain the first lateral side of the user door 105 in the closed position. In one embodiment of the invention, this serves to prevent users from gaining access to the contents of the dispenser by moving the first or the second lateral side of the user door 105 upwardly when the user door 105 is in the locked position.

It should also be understood that in a particular embodiment of the invention, a single actuator may be used to: (1) lock and unlock the user door 105; and (2) move the user door 105 into and out of engagement with a drive mechanism that is adapted to open and close the user door 105.

User Door Drive and Locking Mechanisms with Door Support Assembly

FIGS. 7–10 depict a door drive and locking mechanism that is particularly useful with sliding user doors (such as the first sliding user door 401 shown in FIGS. 1–3) that open downwardly. As may be understood from FIG. 7, this door drive and locking mechanism comprises a door linking mechanism, such as the door linking mechanism 120 described above in regard to FIGS. 5 and 6. The door drive and locking mechanism also comprises a door support assembly 150 that is configured for supporting the weight of the user door 106 when the user door 106 is in a closed position.

As may be understood from FIGS. 7–10, in one embodiment of the invention, the door support assembly 150 comprises a door support member (such as the elongate door support rod 109 shown in FIG. 7) that is attached to move laterally relative to the user door 106. For example, in the embodiment of the invention shown in FIG. 7, the door support rod 109 is slideably mounted to the user door 106 via two door mounts 157, 158. In one embodiment of the invention, the door support rod 109 comprises a stopper 160 adjacent a first end of the door support rod 109.

In a particular embodiment of the invention, the door support assembly 150 includes a biasing mechanism for continuously biasing the door support assembly 150 towards the "unlocked" position. For example, the door support assembly 150 may include a spring 162 that is attached to the user door 106 via support member 164, and that is configured for biasing the support rod 109 so that additional force is required to move the support rod 109 from the "unlocked" to the "locked" position, and so that additional force is also required to maintain the support rod 109 in the "locked" position.

In one embodiment of the invention, a pushing member 167 is provided adjacent the first side of the user door 106 and is configured for moving between: (1) a first position in which the pushing member 167 engages the stopper 160 and exerts a force on the door support rod 109 that is sufficient to maintain the door support assembly 150 in the "locked" position; and (2) a second position in which the pushing member 167 does not engage the stopper 160 and is preferably spaced apart from the first side of the user door 106. In one embodiment of the invention, when the pushing member 167 is in the first position, the pushing member 167 extends through an opening 180 in a first side of the user door 106. In a particular embodiment of the invention, this opening 180 is dimensioned to allow a portion of the pushing member 167 to pass through the opening 180, but to not allow the stopper 160 to pass through the opening 180. Similarly, the opening 180 is preferably dimensioned to allow the user door 106 to be moved a short distance upwardly while the pushing member 167 engages the stopper 160.

As may be understood from FIG. 7, when the door support assembly 150 is in the locked position, a second end 119 of the support rod 109 is adjacent a support member 175. In one embodiment of the invention, this support member 175 engages the second end 119 of the support rod 109 when the user door 106 is in the fully closed position and thereby at least partially supports the weight of the user door 106.

In addition, in one embodiment of the invention, when the door support assembly 150 is in the locked position, the pushing member 167 extends through the opening 180 in the user door 106 and engages a support portion of the user door 106 adjacent the opening 180. This also serves to at least partially support the weight of the user door 106. Accordingly, in one embodiment of the invention, when the user door 106 is in the closed position, the weight of the door is substantially supported by the support member 175 and the pushing member 167.

To open the user door 106, the door linking mechanism 120 is first moved from the locked to the unlocked position as discussed above. The user door 106 is then moved upwardly (preferably a short distance that is less than 3 inches) into a first intermediate position (an example of which is shown in FIG. 8) in which: (1) the user door 106 is a short distance above its fully closed position; and (2) the door support assembly 150 is in the locked position, but the weight of the door is substantially supported by the drive mechanism.

After the user door 106 reaches the first intermediate position, the user door 106 is moved into a second intermediate position (an example of which is shown in FIG. 9) in which: (1) the user door 106 is a short distance above its fully closed position; (2) the door support assembly 150 is in the unlocked position; and (3) the weight of the door is substantially supported by the drive mechanism. This is done by moving the pushing member 167 into a retracted position (e.g., away from the support rod 109) in which the pushing member 167 does not engage the stopper 160 and is preferably spaced apart from the user door 106. Moving the pushing member 167 in this manner causes the second end 119 of the support rod 109 to move into a position in which the support rod's downward path is not substantially obstructed by the support member 175.

Finally, the user door 106 is moved into an open position (an example of which is shown in FIG. 10) by using the first and second drive chains 111, 116 to move the first and second door movement brackets 112, 117 downwardly until the user door 106 is in a fully open position.

To close the door, the steps above are performed in reverse order. More particularly, the user door 106 is first moved from the open position (see FIG. 10) to a second intermediate position (see FIG. 9). The user door 106 is then moved from the second intermediate position to the first intermediate position (see FIG. 8). Finally, the user door 106 is moved into a closed position and the door linking member 120 is moved into a locked position to prevent users from opening the user door 106 as discussed above. An example of a user door 106 in this configuration is shown in FIG. 7.

Detailed Discussion of Further Embodiments of the Invention

FIG. 11 depicts a drive system 500 according to one embodiment of the invention that may be used to open and close one or more sliding user doors. As may be understood from this figure, in one embodiment of the invention, the drive system 500 comprises a motor 501, first and second bearings 517 and 518, left idler sprocket axle 513, right idler sprocket axle 512, end of travel switch 509, unweight switch 541 and home switch 516. These components are preferably mounted to the dispenser's main door 300, which is shown in FIG. 1.

The motor 501, left drive sprocket 502 and right drive sprocket 504 are mounted to the drive shaft 503 so that when the drive shaft 503 is rotated by the motor 501, the left drive sprocket 502 and the right drive sprocket 504 also rotate. A right drive chain 505 extends around an exterior portion of the right drive sprocket 504 and also extends around a portion of a right idler sprocket 510 that is spaced apart from the right drive sprocket 504. The right drive chain 505 is tensioned so that when the motor 501 rotates the drive shaft 503, the right drive sprocket 504 rotates about the central axis of the drive shaft 503 which causes the right drive chain 505 to move around an exterior portion of both the right drive sprocket 504 and an exterior portion of the right idler sprocket 510.

Similarly, a left drive chain 514 extends around an exterior portion of the left drive sprocket 502 and also extends around a portion of a left idler sprocket 511 that is spaced apart from the left drive sprocket 502. The left drive chain 514 is tensioned so that when the motor rotates the drive shaft 503, the left drive sprocket 502 rotates about the central axis of the drive shaft 503 causing the left drive chain 514 to move around an exterior portion of both the left drive sprocket 502 and an exterior portion of the left idler sprocket 511.

In one embodiment of the invention, four door movement brackets 506 are mounted to the left drive chain 514. Similarly, four door movement brackets 506 are also mounted to the right drive chain 505. These door movement brackets 506 are used to move the sliding user doors 401, 402, 403, 404 (see FIG. 1A) relative to the dispenser as described above.

In addition, first, second, third, and fourth switch actuators 507, 508, 515, 540 are mounted to the right drive chain 505. The first switch actuator 507 is adapted to activate a home switch 516 when the right drive chain 505 moves into a home position. In one embodiment of the invention, the right drive chain 505 is in a home position when the right drive chain 505 moves a sliding door (e.g., 401–404) into a closed position.

Second and third switch actuators 508, 515 activate an "end of travel" switch 509 when the right drive chain 505 moves a sliding user door 401–404 into a fully open position. More particularly, the second switch actuator 508 activates the end of travel switch 509 when the first sliding user door 401 is in a fully open position, and the third switch actuator 515 activates the end of travel switch 509 when any of the second, third, or fourth sliding user doors 402, 403 and 404 are in a fully open position. In one embodiment of the invention, the fourth switch actuator 540 and the unweight switch 541 are associated only with the first sliding user door 401. These components are described in greater detail below.

In one embodiment of the invention, the drive system is mounted inside the frame of the dispenser's main door 300 (see FIG. 1A–FIG. 3). In this embodiment, the motor 501, left drive sprocket 502, right drive sprocket 504, drive shaft 503, and bearings 517, 518 are disposed in an upper interior portion 305 of the main door 300 (see FIG. 3). Similarly, in a particular embodiment of the invention, the right idler sprocket 510, the right idler sprocket axle 512, the left idler sprocket 511 and the left idler sprocket axle 513 are disposed in a lower interior portion 306 of the dispenser's main door 300. By the same token, in one embodiment of the invention, the right drive chain 505, first, second and third switch actuators 507, 508, 515, the home switch 516, the end of travel switch 509 and the right-side door movement brackets 506 are disposed within a right interior portion 303 of the dispenser. Similarly, the left drive chain 514 and the left-side door movement brackets 506 are positioned within a left interior portion 304 of the dispenser (see FIG. 3).

FIG. 12A depicts a lock/unlock drive mechanism 590, a user door 402, a door linking assembly 591, and a portion of the open/close drive system 500 (see also FIG. 11). The user door 402 is shown in the closed and locked position. As will be understood by one skilled in the art in light of this disclosure, this user door 402 may alternatively be, for example, any one of the second, third, or fourth user doors 402, 403, 404 or any other suitable door.

As may be understood from FIGS. 12A–12C, in one embodiment of the invention, the lock/unlock drive mechanism 590 comprises an actuator 550, an actuator spring return 551 and an actuator arm 552 that includes a switch actuator 573. The switch actuator 573 is preferably configured to actuate either a "locked" switch 571 or an "unlocked" switch 572 depending on the position of the actuator arm 552.

In a particular embodiment of the invention, the door linking assembly 591 includes a right lift interface 553, a wheel 554, a linking rod 556, a linking support rod mount 555, a rotatable member 560, and a tension spring 558. A linking support rod mount 555 is mounted to the user door 402 and configured to support the linking rod 556 while allowing the linking rod 556 to slide substantially laterally relative to the user door 402.

In one embodiment of the invention, one end of the tension spring 558 is attached to the linking rod 556 at an attachment point 557. The other end of the tension spring 558 is attached to the spring bracket 559, which is mounted to the user door 402. The tension spring 558 is preferably configured to bias the door linking assembly 591 to the left.

The rotatable member 560 comprises a left lift interface 564, a left lock arm 563, a rotatable member pivot 561, and a linking rod pivot 562 that pivotably connects the linking rod 556 to the rotatable member 560. The rotatable member 560 is preferably rotatably mounted to the user door 402 to rotate about the rotatable member pivot 561.

The dispenser further includes a plurality of door stops 565, that may be mounted, for example, to the right and left tracks 301, 302 as shown in FIG. 12A, to prevent the second, third, and fourth sliding user doors 402, 403, 404 from sliding downwardly beyond the fully closed positions.

Generally speaking, in one embodiment of the invention, when the door linking assembly 591 is in a locked position, the user door 402 is maintained in a locked position by: (1) the wheel 554, which is disposed within a cutout in the right track 301 when the wheel 554 is in the locked position; and (2) the left lock arm 563, which is disposed within a cutout in the left track 302 when the left lock arm 563 is in the locked position.

FIGS. 13A and 13B present side views of the left and right tracks 302, 301 the associated cutouts within these tracks 302, 301. In one embodiment of the invention, these cutouts include left channel lifter cutout 352, left channel locking cutout 353, right channel locking cutout 351 and right channel lifter cutout 356. As may be understood from FIGS. 13A and 13B, when the door linking assembly 591 (see FIG. 12A) is in a locked position, the left lock arm 563 is captured by the left locking cutout 353 and the wheel 554 is captured by the right channel cutout 351.

It should be noted that, in one embodiment of the invention, when the user door 402 is locked, the right lift interface 553 and left lift interface 564 (see FIGS. 12A and 13B) are not engaged with the dispenser's door movement brackets 506. This serves to further prevent the user door 402 from being opened by the drive mechanism.

Turning again to FIG. 12A, in one embodiment of the invention, a sliding user door 402 is unlocked and opened as follows. An authorized user gains access to an electronic control system that controls the dispenser via one of many methods that are well known in the art (e.g., by using an ID card, access code, etc.) Next, a control microprocessor (not shown) signals the correct user door to open. Assuming that the correct user door is the sliding user door 402, the actuator 550 for user door 402 is signaled to operate, which causes actuator arm 552 to move laterally from the position shown in FIGS. 12A and 12B to the position shown in FIGS. 14A and 14B. When the actuator arm 552 moves laterally to the right, it pulls the wheel 554 to the right beyond the right channel locking cutout 351 (see FIG. 13B). This, in turn, unlocks the right side of the sliding user door 402. Also, as the wheel 554 moves to the right, the wheel 554 pulls linking rod 556 to the right which causes the rotatable member 560 to rotate counterclockwise about its pivot 561 (see FIG. 14A). This causes the left lock arm 563 to disengage from the left channel locking cutout 353 (see FIG. 13A), which unlocks the left side of the sliding user door 402. The rotation of the rotatable member 560 also causes the left lift interface 564 to engage the door movement bracket 506 on the left drive chain 514. In addition, the lateral movement of the linking rod 556 causes the right lift interface 553 to engage the right door movement bracket 506 on the right drive chain 505.

Next, an "unlocked door" signal is sent to the microprocessor indicating that the sliding user door 402 is unlocked. In one embodiment of the invention, this signal is generated in response to unlocked switch 572 being actuated by the switch actuator arm 573 as shown in FIG. 14A. In response to the microprocessor receiving the "unlocked door" signal, the microprocessor activates the motor 501 (see FIG. 11) which rotates the drive shaft 503 and thereby causes the right and left drive chains 505, 514 and right and left door movement brackets 506 to move upwardly (see FIG. 14A). This, in turn, moves the sliding user door 402 upwardly. In one embodiment of the invention, as the sliding user door 402 moves upwardly, the wheel 554 moves away from the actuator arm 552 and onto an exterior surface of the right track 301 as discussed above.

The motor 501 remains activated until the sliding user door 402 is in a fully open position. When the sliding user door 402 reaches this fully open position, the third switch actuator 515 activates the end of travel switch 409 (see FIG. 11), which signals the microprocessor to deactivate the motor 501. This causes the sliding user door to stop moving upwardly.

To close the sliding user door 402, the microprocessor sends a signal to the motor 501 to rotate in a direction that is opposite to the direction in which the motor 501 rotated to open the sliding user door 402. This causes the sliding user door 402 to move in a downward direction. The microprocessor determines when to close the door based on any appropriate method such as: (1) the door has been open for a predetermined period of time; or (2) a sensor determines that a user is no longer using the dispenser.

When the sliding user door 402 reaches a fully closed position, the first switch actuator 507 activates a home switch 516 (see FIG. 11). The home switch 516 then transmits a signal to the microprocessor. In response to receiving this signal, the microprocessor deactivates the motor 501. This, in turn, stops the downward motion of the user door 402.

In this fully closed position, the wheel 554 (see FIGS. 14A & 14B) is again positioned over the right channel locking cutout 351 (see FIG. 13B), the solenoid 550 is deactivated, and the tension spring 558 pulls the wheel 554 into the right channel locking cutout 351. This, in turn, relocks the right side of the sliding user door 402. At the same time, the left side of the user door 402 is relocked because rotatable member 560 rotates clockwise so that left lock arm 563 re-engages the left channel locking cutout 353.

The above-described apparatus and techniques are particularly useful in conjunction with user doors, such as the second, third, and fourth user doors 402, 403, 404 (see FIG. 1A) which open upwardly. However, for reasons described below, it is often desirable to provide a modified apparatus for use in opening and locking sliding user doors, such as user door 401, that open downwardly. Such an apparatus (which may also be used on upwardly opening user doors) is described below.

In one embodiment of the invention, first sliding user door 401 (see FIG. 1A) operates in much the same manner as second, third, and fourth sliding user doors 402, 403, 404 except that first sliding user door 401 moves downwardly to open and upwardly to close. Because, in one embodiment of the invention, the first sliding user door 401 moves downwardly to open and upwardly to close, it is desirable to have the rotatable member 560 and actuator arm 552 be inverted from the positions described in regard to FIG. 12A. Thus, while the left lock arm 563 is described in regard to FIG. 12A as being positioned below the left lift interface 564, in a particular embodiment of the invention shown in FIG. 15, the left lock arm 563 is positioned above the left lift interface 564. This serves to facilitate the movement of the left lock arm 563 past the left channel locking cutout 353 (see FIG. 16A) when the user door 401 is moved downwardly into an open position.

Similarly, while the actuator arm 552 is described as being positioned below the linking rod 556 in FIG. 12A, in one embodiment of the invention (shown in FIG. 15), the actuator arm 552 is positioned generally above the linking rod 556. This serves to facilitate the movement of the wheel 554 past the actuator arm 552 when the user door 401 is moved downwardly into an open position.

It should be understood that rather than inverting the rotatable member 560 and the actuator arm 552 as described above, the shape of the rotatable member 560 and the location and shape of the portions of the dispenser that define the left channel locking cutout 353 may be selected so that: (1) the left lock arm 563 may move past the left channel locking cutout 353 (see FIG. 16A) when the user door 401 is moved downwardly into an open position; and (2) the wheel 554 may move past the actuator arm 552 when the user door 401 is moved downwardly into an open position. As will be understood by one skilled in the art, many such configurations are possible and are within the scope of the invention.

Also, as noted above, in one embodiment of the invention (shown in FIG. 15), the first sliding user door 401 includes a door support assembly 600 that supports the sliding user door 401 when the sliding user door 401 is in the closed position. As will be understood by one skilled in the art, this door support assembly 600 is especially useful when the sliding user door 401 is heavy enough to cause the door linking assembly 591 to potentially jam due to the weight of the user door 401. Accordingly, in various embodiments of the invention, the door support assembly 600 may be omitted.

As may be understood from FIG. 15, in one embodiment of the invention, the door support assembly 600 includes a support rod 601, one or more support rod mounts 602, a spring 603, a stopper 604, a pushing member 605 and an actuator 606. The support rod 601 is mounted to slide laterally relative to the first user door 401 by the support rod mounts 602. In one embodiment of the invention, the actuator 606 is mounted to the dispenser's main door (not shown). The stopper 604, which is preferably mounted adjacent a first end of the support rod 601, is preferably large enough to physically prevent the stopper 604 from passing through the sliding user door right cutout 701 (see FIG. 17).

When the first sliding user door 401 is locked, the left end of rod 601 extends into a left cutout 700 in the dispenser's left track 302 and the pushing member 605 passes through a hole 609 in the dispensers' right track 301 as shown in FIGS. 16A–16B. Also, the pushing member 605 extends into the sliding user door right cutout 701 in sliding user door 401 as shown in FIG. 17.

To open the sliding user door 401, the microprocessor first moves the door linking assembly 591 into an unlocked position. The microprocessor then activates motor 501 which moves the sliding user door 401 upwardly until the driving switch actuator 540 engages unweight switch 541 (See FIG. 11). Unweight switch 541 then transmits a signal to the microprocessor causing the microprocessor to deactivate the motor 501. At this point, the weight of the sliding user door 401 is no longer supported by the door latching mechanism 600. It should be understood that the cutouts 700 and 701 are preferably elongate to allow for this upward movement of the first sliding user door 401.

Next, as may be understood from FIG. 18, the microprocessor activates the pushing member actuator 606, which causes the pushing member 605 to withdraw toward the actuator 606 so that the pushing member 605 no longer extends through the sliding user door right cutout 701. At the same time, the rod 601 is moved to the right due to the biasing force of spring 603 until the stopper 604 engages the right interior side of the sliding user door 401. At this point, the rod 601 no longer extends through the left cutout 700 or rod end switch 610. (See FIGS. 16A–18).

In response to the rod 601 moving away from the rod end switch 610, the rod end switch 610 transmits a signal to the microprocessor. This causes the microprocessor to activate the motor 501 (see FIG. 11) to move the sliding user door 401 downwardly until the user door 401 is in a fully open position in which the second switch actuator 508 activates the end of travel switch 509. Once the second switch actuator 508 activates the end of travel switch 509, the end of travel switch 509 transmits a signal to the microprocessor which then deactivates the motor 501 to stop the downward motion of the user door 401.

To close the sliding user door 401, the microprocessor activates the motor 501 to move the user door 401 upwardly until the fourth switch actuator 540 activates the unweight switch 541. The microprocessor then activates pushing member actuator 606 (see FIG. 18) to cause the pushing member 605 to engage the stopper 604 and force the support rod 601 to the left until the support rod 601 passes through the left cutout 700 and engages the rod end switch 610 (see FIG. 16A and FIG. 18).

In response to the support rod 601 moving into engagement with the rod end switch 610, the rod end switch 610 transmits a signal to the microprocessor. In response to receiving this signal, the microprocessor activates the motor 501 (see FIG. 11) to move the sliding user door 401 downwardly until the user door 401 is in a fully closed position in which the first switch actuator 507 activates the home switch 516. Once the first switch actuator 507 activates the home switch 516, the home switch 516 transmits a signal to the microprocessor which then deactivates the motor 501 to stop the downward motion of the user door 401. The microprocessor then deactivates the door locking actuator 550 which relocks and disengages the door linking assembly 591 from the door movement brackets 506. After this occurs, the sliding user door 401 is in a closed and locked position.

CONCLUSION

Many modifications and other embodiments of the invention will come to mind to one skilled in the art to which this invention pertains having the benefit of the teachings presented in the foregoing descriptions and the associated drawings. Also, as will be understood by one skilled in the art, the dispenser may be used, in either a modified or unmodified form, in many different contexts. For example, the dispenser may be used to dispense linens in a health care facility, towels in a health club, or towels or linens in a hotel environment. Similarly, the dispenser may be used, either in a modified or unmodified form, to dispense items such as fabric items, medical supplies, tools, and office supplies.

Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

I claim:

1. A drive mechanism for moving a sliding door relative to an enclosure, said sliding door having a first lateral side and a second lateral side, said drive mechanism comprising:

a drive assembly comprising:

a first drive subassembly tat is adjacent said first lateral side of said sliding door; and a second drive subassembly that is adjacent said second lateral side of said sliding door; and a door linking assembly that is configured to be moved between:

(A) a first position, in which said door linking assembly is positioned to link said sliding door to said drive assembly and thereby allow said drive assembly to slide said sliding door relative to said enclosure; and (B) a second position, in which said door linking assembly is not positioned to link said sliding door to said drive assembly.

2. The drive mechanism of claim 1, wherein said first and second doors are positioned in a substantially vertical array.

3. The drive mechanism of claim 1, wherein said drive mechanism comprises a door linking assembly drive mechanism tat is configured for moving said door linking assembly between said first and second positions.

4. The drive mechanism of claim 1, wherein said door linking assembly is adapted to link said sliding door to said first drive subassembly when said door linking assembly is in said first position.

5. The drive mechanism of claim 4, wherein said door linking assembly is adapted so that when said door linking assembly is in said second position, said door linking assembly is positioned to prevent a user from opening said sliding door.

6. The drive mechanism of claim 1, wherein said door linking assembly is adapted to link said sliding door to both said first drive subassembly and said second drive subassembly when said door linking assembly is in said first position.

7. The drive mechanism of claim 6, wherein said door linking assembly is adapted so that when said door linking assembly is in said second position, said door linking assembly is positioned to prevent a user from opening said sliding door.

8. The drive mechanism of claim 7, wherein said door linking assembly is configured to engage a restricting member adjacent said sliding door when said door linking assembly is in said second position and thereby prevent said user from opening said sliding door.

9. The drive mechanism of claim 8, wherein:

said restricting member is a first restricting member that is located adjacent said first lateral side of said sliding door; and said door linking assembly is configured to engage both said first restricting member and a second restricting member when said door linking assembly is in said second position, said second restricting member being located adjacent said second lateral side of said sliding door.

10. The drive mechanism of claim 1, wherein said door linking assembly is configured so that when said door linking assembly is in said second position, said door linking assembly is positioned to prevent a user from opening said sliding door.

11. The drive mechanism of claim 10, wherein said door linking assembly is adapted to engage a restricting member adjacent said sliding door when said door linking assembly is in said second position and thereby prevent said user from opening said sliding door.

12. The drive mechanism of claim 11, wherein:

said restricting member is a first restricting member that is located adjacent said first lateral side of said sliding door; and said door linking assembly is configured to engage both said first restricting member and a second restricting member when said door linking assembly is in said second position, said second restricting member being located adjacent said second lateral side of said sliding door.

13. The drive mechanism of claim 1, wherein said door linking assembly comprises a rotatable member that is adapted so that:

when said door linking assembly is in said first position, said rotatable member is in a first angular orientation in which said rotatable member engages said drive assembly so that said drive assembly is in driving engagement with said sliding door; and when said door linking assembly is in said second position, said rotatable member is in a second angular orientation in which said rotatable member does not engage said drive assembly in a manner that causes said drive assembly to be in driving engagement with said sliding door.

14. The drive mechanism of claim 13, wherein said rotatable member is adapted so that when said door linking assembly is in said second position, said rotatable member engages a restricting member adjacent said door.

15. The drive mechanism of claim 14, wherein said rotatable member is adapted so that:

when said door linking assembly is in said first position, a first portion of said rotatable member engages said drive assembly; and when said door linking assembly is in said second position, a second portion of said rotatable member engages said restricting member.

16. The chive mechanism of claim 15, wherein:

said first portion of said rotatable member is a first elongate portion of said rotatable member; and said second portion of said rotatable member is a second elongate portion of said rotatable member.

17. The drive mechanism of claim 16, wherein said rotatable member is substantially U-shaped.

18. The drive mechanism of claim 16, wherein said rotatable member is substantially V-shaped.

19. The drive mechanism of claim 1, wherein said door linking assembly is configured to prevent said user from opening said sliding door by simultaneously engaging a first restricting member adjacent said first lateral side of said sliding door, and engaging a second restricting member adjacent a second lateral side of said sliding door.

20. A dispenser for dispensing items to a user, said dispenser comprising:

a plurality of compartments, each of said compartments defining an interior portion and an opening through which a user may access items stored within said interior portion;

a first sliding door that is positioned to selectively restrict access to a first one of said compartments by sliding between a first-door closed position, in within said first sliding door prevents users from accessing an interior portion of said first compartment, and a first-door open position, in which said first sliding door allows users to access said interior portion of said first compartment, said first sliding door being positioned in front of an access opening of said first compartment when said first sliding door is in said first-door closed position, and said first sliding door being positioned substantially below said access opening of said first compartment when said first sliding door is in said first-door open position;

a second sliding door that is positioned to selectively restrict access to a second one of said compartments by sliding between a second-door closed position, in which said second sliding door prevents users from accessing an interior portion of said second compartment, and a second-door open position, in which said second sliding door allows users to access said interior portion of said second compartment, said second sliding door being positioned in front of an access opening of said second compartment when said second sliding door is in said second-door closed position, and said second sliding door being positioned substantially above said access opening of said second compartment when said second sliding door is in said second-door open position; and a single drive assembly that is adapted to:

move said first door between said first-door open position and first-door closed position; and move said second door between said second-door open position and second-door closed position.

21. A dispenser for dispensing items to a user, said dispenser comprising:

a plurality of compartments, each of said compartments defining an interior portion and an opening through which a use may access items stored within said interior portion;

a first sliding door that is positioned to selectively restrict access to a first one of said compartments by sliding between a first-door closed position, in which said first sliding door prevents users from accessing an interior portion of said first compartment, and a first-door open position, in which said first sliding door allows users to access said interior portion of said first compartment, said first sliding door being positioned in front of an access opening of said first compartment when said first sliding door is in said first-door closed position, and said first sliding door being positioned substantially below said access opening of said first compartment when said first sliding door is in said first-door open position;

a second sliding door that is positioned to selectively restrict access to a second one of said compartments by sliding between a second-door closed position, in which said second sliding door prevents users from accessing an interior portion of said second compartment, and a second-door open position, in which said second sliding door allows users to access said interior portion of said second compartment, said second sliding door being positioned in front of an access opening of said second compartment when said second sliding door is in said second-door closed position, and said second sliding door being positioned substantially above said access opening of said second compartment when said second sliding door is in said second-door open position; and a third sliding door that is positioned to selectively restrict access to a third one of said compartments by sliding between a third-door closed position, in which said third sliding door prevents users from accessing an interior portion of said third compartment, and a third-door open position, in which said third sliding door allows users to access said interior portion of said third compartment, said third sliding door being positioned in front of an access opening of said third compartment when said third sliding door is in said door-compartment closed position, and said third sliding door being positioned substantially above said access opening of said third compartment when said third sliding door is in said third-door open position.

22. The dispenser of claim 21, further comprising a single drive assembly that is adapted to:

move said first door between said first-door open position and first-door closed position;

move said second door between said second-door open position and second-door closed position; and move said third door between said third-door open position and third-door closed position.

23. The dispenser of claim 21, wherein said first sliding door is disposed adjacent a top portion of said dispenser when said first sliding door is in said first-door closed position.

24. A dispenser for dispensing items to a user, said dispenser comprising:

a plurality of compartments, each of said compartments defining interior portion and an opening through which a user may access items stored within said interior portion;

a first sliding door that is associated with a first one of said compartments, and that is positioned to selectively restrict access to said first one of said compartments by sliding, in a substantially vertical direction, between a first-door closed position, in which said first sliding door prevents users from accessing an interior portion of said first compartment, and a first-door open position, in which said first sliding door allows users to access said interior portion of said first compartment;

a second sliding door that is associated with a second one of said compartments, and that is positioned to selectively restrict access to said second one of said compartments by sliding, in a substantially vertical direction, between a second-door closed position, in which said second sliding door prevents users from accessing an interior portion of said second compartment, and a second-door open position, in which said second sliding door allows users to access said interior portion or said second compartment; and a single drive assembly that is adapted to:

move said first door between said first-door open position and first-door closed position; and move said second door between said second-door open position and second-door closed position.

25. A dispenser for dispensing items to a user, said dispenser comprising:

a plurality of compartments, each of said compartments defining an interior portion and an opening through which a user may access items stored within said interior portion;

a first sliding door that is associated with a first one of said compartments, and that is positioned to selectively restrict access to said first one of said compartments by sliding, in a substantially vertical direction, between a first-door closed position, in which said first sliding door prevents users from accessing an interior portion of said first compartment, and a first-door open position, in which said first sliding door allows users to access said interior portion of said first compartment;

a second sliding door that is associated with a second one of said compartments and that is positioned to selectively restrict access to said second one of said compartments by sliding, in a substantially vertical direction, between a second-door closed position, in which said second sliding door prevents users from accessing an interior portion of said second compartment, and a second-door open position, in which said second sliding door allows users to access said interior portion of said second compartment;

a third sliding door that is positioned to selectively restrict access to a third one of said compartments by sliding, in a substantially vertical direction, between a third-door closed position, in which said third sliding door prevents users from accessing an interior portion of said third compartment, and a third-door open position, in which said third sliding door allows users to access said interior portion of said third compartment; and a single chive assembly that is adapted to:

move said first door between said first-door open position and first-door closed position;

move said second door between said second-door open position and second-door closed position; and move said third door between said third-door open position and third-door closed position.

26. A dispenser for dispensing items to a user, said dispenser comprising:

a compartment that defines both an interior portion and an opening through which a user may access said interior portion;

a sliding door that is adapted to selectively restrict access to said compartment by sliding between a door closed position, in which said sliding door prevents users from accessing said interior portion of said compartment, and a door open position, in which said sliding door allows users to access said interior portion of said compartment;

a door support that is adapted to support said sliding door when said sliding door is in said door closed position, said door support being adapted to be moved from a first position in which said door support is positioned to support said door when said door is in said door closed position, and a second position in which said door support is not positioned to support said door when said door is in said door closed position; and a drive mechanism that is adapted to move said sliding door from said door closed position to an intermediate position in which said door support is out of supporting engagement with said sliding door.

27. The dispenser of claim 26, wherein said drive mechanism is a first drive mechanism and said dispenser further comprises a second drive mechanism for moving said door support between said first and second positions.

28. The dispenser of claim 27, wherein said second drive mechanism is configured to move said door support from said first position to said second position while said door is in said intermediate position, and said first drive mechanism is configured to move said sliding door from said intermediate position to said door open position after said second drive mechanism has moved said door support into said second position.

29. The dispenser of claim 26, wherein said door support is extended when in said first position and retracted when in said second position.

30. A method of dispensing items to a customer said method comprising:

providing a first door that is adapted to selectively restrict access to a first set of one or more items by sliding in a first substantially vertical direction relative to a dispenser;

providing a second door that is adapted to selectively restrict access to a second set of one or more items by sliding in a second substantially vertical direction relative to said dispenser, said second substantially vertical direction being substantially opposite said first substantially vertical direction; and providing a single drive assembly that is adapted to:

move said first door in said first substantially vertical direction; and move said second door in said second substantially vertical direction.

31. A method of dispensing items to a customer, said method comprising:

providing a first door that is adapted to selective restrict access to a first set of one or more items by sliding in a first substantially vertical direction relative to a dispenser;

providing a second door that is adapted to selectively restrict access to a second set of one or more items by sliding in a second substantially vertical direction relative to said dispenser, said second substantially vertical direction being substantially opposite said first substantially vertical direction;

providing a third user door that is adapted to selectively allow access to a third set of one or more items by moving said second substantially vertical direction relative to said dispenser;

providing a single drive assembly that is adapted to:

move said first door in said first substantially vertical direction; and move said second and third doors in said second substantially vertical direction.

32. The method of claim 31, wherein said single drive assembly is further adapted to move said third door between said third-door open position and third-door closed position.

33. A drive mechanism for moving a sliding door relative to an enclosure, said drive mechanism comprising:

a drive assembly;

a door linking assembly that is configured to be moved between:

(A) a first position, in which said door linking assembly is positioned to link said sliding door to said drive assembly, and thereby allow said drive assembly to slide said door relative to said enclosure; and (B) a second position, in which said door linking assembly is positioned to prevent a user from moving said sliding door into an open position, wherein:

said drive assembly comprises a first drive subassembly and a second drive subassembly; and said door linking assembly links said sliding door to both said first drive subassembly and said second drive subassembly when said door linking assembly is in said first position.

34. The drive mechanism of claim 33, wherein said first and second drive subassemblies are disposed adjacent opposite lateral sides of said sliding door.

35. A drive mechanism for moving a sliding door relative to an enclosure, said drive mechanism comprising a drive assembly;

a door linking assembly that is configured to be moved between:

(A) a first position, in which said door linking assembly is positioned to link said sliding door to said drive assembly, and thereby allow said drive assembly to slide said door relative to said enclosure; and (B) a second position, in which said door linking assembly is positioned to prevent a user from moving said sliding door into an open position, wherein:

said door linking assembly is configured to engage a restricting member adjacent said sliding door when said door linking assembly is in said second position and thereby prevent said user from opening said sliding door.

36. The drive mechanism of claim 35, wherein:

said restricting member is a first restricting member that is located adjacent said first lateral side of said sliding door; and said door linking assembly is configured to engage both said first restricting member and a second restricting member when said door linking assembly is in said second position, said second restricting member being located adjacent said second lateral side of said sliding door.

37. A drive mechanism for moving a sliding door relative to an enclosure, said drive mechanism comprising:

a drive assembly;

a door linking assembly that is configured to be moved between:

(A) a first position, in which said door linking assembly is positioned to link said sliding door to said drive assembly, and thereby allow said drive assembly to slide said door relative to said enclosure; and (B) a second position, in which said door linking assembly is positioned to prevent a user from moving said sliding door into an open position, wherein:

said door linking assembly comprises a rotatable member that is adapted so that:

when said door linking assembly is in said first position, said rotatable member is in a first angular orientation in which said rotatable member engages said drive assembly so that said drive assembly is in driving engagement with said sliding door; and when said door linking assembly is in said second position, said rotatable member is in a second angular orientation in which said rotatable member does not engage said drive assembly in a manner that causes said drive assembly to be in driving engagement with said sliding door.

38. The drive mechanism of claim 37, wherein said rotatable member is adapted so that when said door linking assembly is in said second position, said rotatable member engages a restricting member adjacent said door.

39. The drive mechanism of claim 38, wherein said rotatable member is adapted so that:

when said door linking assembly is in said first position, a first portion of said rotatable member engages said drive assembly; and when said door linking assembly is in said second position, a second portion of said rotatable member engages said restricting member.

40. The drive mechanism of claim 39, wherein:

said first portion of said rotatable member is a first elongate portion of said rotatable member; and said second portion of said rotatable member is a second elongate portion of said rotatable member.

41. The drive mechanism of claim 40, wherein said rotatable member is substantially U-shaped.

42. The drive mechanism of claim 40, wherein said rotatable member is substantially V-shaped.

* * * * *

UNITED STATES PATENT AND TRADEMARK OFFICE

CERTIFICATE OF CORRECTION

PATENT NO. : 7,134,242 B2
APPLICATION NO. : 10/671301
DATED : November 14, 2006
INVENTOR(S) : Fitzgerald It is certified that error appears in the above-identified patent and that said Letters Patent is hereby corrected as shown below:

Column 17,

Line 42 and 59, “tat” should read --that--.

Column 19,

Line 9, “chive” should read --drive--.

Column 20,

Line 3, “use” should read --user--.

Line 63, after “defining” insert --an--.

Column 21,

Line 16, “or” should read --of--.

Line 56, “chive” should read --drive--.

Column 22,

Line 66, after “moving” insert --in--.

UNITED STATES PATENT AND TRADEMARK OFFICE

CERTIFICATE OF CORRECTION

PATENT NO. : 7,134,242 B2
APPLICATION NO. : 10/671301
DATED : November 14, 2006
INVENTOR(S) : Fitzgerald It is certified that error appears in the above-identified patent and that said Letters Patent is hereby corrected as shown below:

Column 23,

Line 31, after "comprising" insert --:--.

Signed and Sealed this

Twelfth Day of August, 2008

JON W. DUDAS
*Director of the United States Patent and Trademark Office*